US009221528B2

(12) United States Patent
Gasper

(10) Patent No.: US 9,221,528 B2
(45) Date of Patent: Dec. 29, 2015

(54) WAKE TOWERS AND METHODS OF USE AND MANUFACTURE THEREOF

(71) Applicant: MALIBU BOATS, LLC, Merced, CA (US)

(72) Inventor: Daniel Lee Gasper, Atwater, CA (US)

(73) Assignee: Malibu Boats, LLC, Merced, CA (US)

( * ) Notice: Subject to any disclaimer, the term of this patent is extended or adjusted under 35 U.S.C. 154(b) by 0 days.

(21) Appl. No.: 13/940,700

(22) Filed: Jul. 12, 2013

(65) Prior Publication Data

US 2014/0083348 A1 Mar. 27, 2014

Related U.S. Application Data

(63) Continuation of application No. 13/463,613, filed on May 3, 2012, now Pat. No. 8,485,119, which is a continuation of application No. 12/714,318, filed on Feb. 26, 2010, now Pat. No. 8,171,874.

(51) Int. Cl.
*B63B 17/02* (2006.01)
*B63B 35/81* (2006.01)

(52) U.S. Cl.
CPC ..... *B63B 35/815* (2013.01); *Y10T 29/49622* (2015.01)

(58) Field of Classification Search
USPC ..... 114/361
IPC ..... B63B 17/02,35/815
See application file for complete search history.

(56) References Cited

U.S. PATENT DOCUMENTS 2,524,188 A 10/1950 Christie
2,821,726 A 2/1958 Correll
2,997,188 A 8/1961 Hauser
3,034,470 A 5/1962 Vanderfeltz et al.
D195,068 S 4/1963 Griparis
3,122,609 A 2/1964 Moore
3,336,894 A 8/1967 Eisner
3,352,275 A 11/1967 Wilson (Continued)

FOREIGN PATENT DOCUMENTS

JP 04-071985 3/1992
JP 07-277274 10/1995
JP 2001-294195 10/2001

OTHER PUBLICATIONS

Various pages from *Wake Boarding Magazine*, from Dec. 2000 and earlier.

(Continued)

*Primary Examiner* — Stephen Avila
(74) *Attorney, Agent, or Firm* — Knobbe, Martens, Olson & Bear, LLP

(57) ABSTRACT

A wake tower for a powerboat for use in wakeboarding or other water sports is described. The wake tower can include base members attached to the powerboat and a U-shaped bar extending generally upwardly from the base members. The side bars can be tapered inward and can also be angled toward the bow of the powerboat. Support members can be positioned along the side bars to provide increased structural support to increase the maximum load of the wake tower and to increase the rigidity of the wake tower resulting in less shaking during use. A tow cross bar having a tow rope connector can be suspended generally between the side bars of the wake tower. The wake tower can be transitioned between an upright position and a lowered position.

20 Claims, 20 Drawing Sheets

(56) References Cited

U.S. PATENT DOCUMENTS

| | | | |
|---|---|---|---|
| 3,503,358 | A | 3/1970 | Moesly |
| 3,724,595 | A | 4/1973 | Green |
| 3,802,374 | A | 4/1974 | Brown |
| 3,811,143 | A | 5/1974 | Page |
| 3,890,918 | A | 6/1975 | Sell |
| 3,919,963 | A | 11/1975 | Cox, III |
| 3,925,836 | A | 12/1975 | Simmonds |
| 3,935,830 | A | 2/1976 | Cox |
| 3,949,698 | A | 4/1976 | Sell |
| 3,965,837 | A | 6/1976 | Michael |
| 3,987,746 | A | 10/1976 | McCulloh |
| 4,033,280 | A | 7/1977 | Wood et al. |
| 4,163,529 | A | 8/1979 | Krenzer et al. |
| 4,341,177 | A | 7/1982 | Miyazaki et al. |
| 4,453,482 | A | 6/1984 | Barker |
| 4,528,927 | A | 7/1985 | Iizuka et al. |
| 4,561,375 | A | 12/1985 | Paxton |
| 4,593,641 | A | 6/1986 | Adams et al. |
| D284,754 | S | 7/1986 | Shields |
| 4,641,597 | A | 2/1987 | Paxton |
| 4,694,773 | A | 9/1987 | Sparkes et al. |
| 4,893,577 | A | 1/1990 | Jennings |
| 5,018,474 | A | 5/1991 | Jellen |
| 5,050,517 | A | 9/1991 | Kobayashi |
| 5,052,326 | A | 10/1991 | Wiggen et al. |
| 5,105,754 | A | 4/1992 | Collins |
| 5,215,025 | A | 6/1993 | Talmor |
| 5,417,178 | A | 5/1995 | Harrelson, II |
| 5,453,572 | A | 9/1995 | Kobayashi et al. |
| 5,520,133 | A | 5/1996 | Wiegert |
| 5,520,139 | A | 5/1996 | King et al. |
| 5,645,003 | A | 7/1997 | Grinde |
| 5,669,325 | A | 9/1997 | Feikema |
| 5,673,507 | A | 10/1997 | Stokes, Jr. |
| D395,866 | S | 7/1998 | Fowler et al. |
| 5,787,835 | A | 8/1998 | Remnant |
| 5,860,766 | A | 1/1999 | Lochtefeld et al. |
| D409,972 | S | 5/1999 | Todd |
| 5,934,217 | A | 8/1999 | Allsop |
| 5,943,977 | A | 8/1999 | Womack et al. |
| 5,979,350 | A | 11/1999 | Larson et al. |
| 6,044,788 | A | 4/2000 | Larson et al. |
| 6,192,819 | B1 | 2/2001 | Larson et al. |
| D442,910 | S | 5/2001 | Metcalf |
| 6,374,762 | B1 | 4/2002 | Larson et al. |
| RE37,823 | E | 9/2002 | Larson et al. |
| D462,932 | S | 9/2002 | Larson |
| D474,144 | S | 5/2003 | Zsido |
| D480,349 | S | 10/2003 | Carlton |
| 6,666,159 | B2 | 12/2003 | Larson et al. |
| D486,441 | S | 2/2004 | Metcalf |
| D489,314 | S | 5/2004 | Metcalf |
| 6,792,888 | B1 | 9/2004 | Metcalf |
| 6,865,999 | B2 | 3/2005 | Bierbower, Jr. |
| 6,986,321 | B2 | 1/2006 | Metcalf |
| 7,013,830 | B1 | 3/2006 | Willis |
| D534,855 | S | 1/2007 | Metcalf |
| 7,219,617 | B2 | 5/2007 | Metcalf |
| D551,154 | S | 9/2007 | Metcalf |
| D555,545 | S | 11/2007 | Peek |
| 7,299,761 | B2 | 11/2007 | Larson et al. |
| 7,302,907 | B2 | 12/2007 | Carlton |
| 7,392,758 | B2 | 7/2008 | Metcalf |
| D605,575 | S | 12/2009 | Oswell et al. |
| D611,397 | S | 3/2010 | Oswell et al. |
| 7,699,016 | B2 | 4/2010 | Snook et al. |
| D658,566 | S | 5/2012 | Gros |
| 8,171,874 | B2 | 5/2012 | Gasper |
| 8,196,542 | B2 | 6/2012 | Oswell et al. |
| D664,495 | S | 7/2012 | Oswell et al. |
| D666,135 | S | 8/2012 | Gasper |
| D669,835 | S | 10/2012 | Gros |
| D678,168 | S | 3/2013 | Gasper |
| D679,236 | S | 4/2013 | Gros et al. |
| D686,968 | S | 7/2013 | Gasper |
| D686,970 | S | 7/2013 | Gasper |
| 8,485,119 | B2 | 7/2013 | Gasper |
| 8,495,967 | B2 | 7/2013 | Williams et al. |
| 8,555,802 | B2 | 10/2013 | Oswell et al. |
| 2004/0144295 | A1 | 7/2004 | Bierbower, Jr. |
| 2004/0187764 | A1 | 9/2004 | Eck et al. |
| 2006/0180072 | A1 | 8/2006 | Metcalf |
| 2007/0137554 | A1 | 6/2007 | Metcalf |
| 2009/0314194 | A1 | 12/2009 | Metcalf |
| 2010/0162937 | A1 | 7/2010 | Larson et al. |
| 2010/0319603 | A1 | 12/2010 | Oswell et al. |
| 2011/0139057 | A1 | 6/2011 | Metcalf |

OTHER PUBLICATIONS

Various pages from *Wake Board and Water Ski Business*, Fall 1998 Trade Show Issue.

U.S. Appl. No. 29/461,925, filed Jul. 29, 2013, Gasper.

The University of Florida, Intercollegiate Activity, pub. Jul. 1981, p. 69.

Various pages from *Water Ski*, from Dec. 1998 and earlier.

Various pages from *Sport Fishing*, from Mar. 1996 and earlier.

Various pages from *Marlin*, from Jul. 1996.

Photographs, circa 1950, Cypress Gardens, FL archives.

Photograph, circa 1948, Earl "Pappy" Hollowell, Panorama City.

"How to Buy a Wakeboard Tower or Towers," downloaded Jul. 9, 2009 from www.wakeboarder.com/features/buy_a_wakeboard_tower.phtml, 8 pages.

Joystick downloaded from www.joystickpylons.com on Dec. 12, 1998.

Excerpt from *Water Skier Yearbook*, American Water Ski Association, Aug. 1963.

Excerpt from Pope, *Water Skiing*, at least as early as Jan. 2009.

Excerpt from Taco Supply Marine Catalog, 1987-1988.

Illusion XS Tower, at least as early as Jan. 2009.

WAKE TOWERS AND METHODS OF USE AND MANUFACTURE THEREOF

CROSS REFERENCE TO RELATED APPLICATIONS

This application is a continuation of U.S. patent application Ser. No. 13/463,613, filed May 3, 2012, issued on Jul. 16, 2013 as U.S. Pat. No. 8,485,119, and titled "WAKE TOWERS AND METHODS OF USE AND MANUFACTURE THEREOF," which is a continuation of U.S. patent application Ser. No. 12/714,318, filed Feb. 26, 2010, issued on May 8, 2012 as U.S. Pat. No. 8,171,874, and titled "WAKE TOWERS AND METHODS OF USE AND MANUFACTURE THEREOF," the entirety of each of which is hereby incorporated by reference and made a part of this specification for all that it discloses.

BACKGROUND OF THE INVENTION

1. Field of the Invention

Certain embodiments disclosed herein relate to equipment and methods for water sports such as wakeboarding. More particularly, certain embodiments relate to wake towers for use with powerboats for towing a participant behind the powerboat using a tow rope attached to the wake tower.

2. Description of the Related Art

In recent years the sport of wakeboarding has become very popular. It is often preferable to anchor the towline used to tow the wakeboarder at a relatively high elevation above the deck of the boat. Accordingly, a large number of elevated wake towers of various constructions have been developed. Nevertheless, the existing wake towers have many deficiencies.

SUMMARY OF THE INVENTION

A tower for use with a boat is disclosed. In some embodiments, a wake tower can include a right base member configured to be secured to a sports boat, a left base member configured to be secured to the sports boat, a right side bar extending upwardly from the right base member, a left side bar extending upwardly from the left base member, a right support member that runs along the right side bar to provide structural support to the right side bar, a left support member that runs along the left side bar to provide structural support to the left side bar, and a tow rope connector suspended generally between the right and left side bars, the tow rope connector configured to receive a tow rope.

The right support member can run substantially parallel to the right side bar, and the left support member can run substantially parallel to the left side bar. In some embodiments, at least one of the right and left support members can secure to the corresponding right or left side bar at multiple securing locations along the length of the corresponding right or left side bar and at least one of the right and left support members can include multiple openings formed between the securing locations. In some embodiments, the right and left support members are not configured to secure to the sport boat at any connection points other than those provided by the right and left base members. The right and left support members can be configured to secure to the corresponding right and left base members. In some embodiments, the wake tower is configured to be secured to the boat at only the two connection points provided by the right and left base members.

The right and left support members can be made of machined billet metal. The right and left support members can be solid (e.g., not hollow). The right and left side bars can include tubular piping.

The wake tower can also include a support cross bar that extends from the right side bar to the left side bar. The right side bar, the left side bar, and the support cross bar can form a generally curved, generally U-shaped structure extending from the right base member to the left base member.

The wake tower can include a tow cross bar extending or suspended generally between the right and left side bars, and the tow rope connector can be attached to the tow cross bar. The tow cross bar can be attached to the right and left support members. The tow cross bar can be removably attachable to the right and left support members.

The right and left side bars can be configured to extend upwardly from the corresponding right and left base members at an acute angle toward the bow of the boat in a forward sweep. The right and left side bars can be configured to extend upwardly from the corresponding right and left base members at an angle tapered inwardly, such that the distance between corresponding portions of the side bars at the top is less than the distance between corresponding portions of the side bars at the bottom or at some other region below the top.

In some embodiments, the right and left side bars can be pivotally attached to the right and left base members using joints such that the wake tower can be pivoted between an upright position and a lowered position. The right and left side bars can be pivotally attached to the right and left base members using swivel hinges. The right and left side bars can be pivotally attached to the right and left base members using heim joints. The right and left side bars can include tubular piping defining interior chambers, and the joints can be disposed inside the interior chambers such that the joints are substantially hidden from view.

The right and left support members can be removably attachable to the corresponding right and left base member. The right and left base members can be secured to the corresponding right and left base members when the wake tower is in the upright position to prevent the wake tower from pivoting toward the lowered position, and the right and left support members can be detached from the corresponding right and left base members when the wake tower is in the lowered position.

The wake tower can include right and left dampening members, such as shocks, configured to bias the wake tower toward the upright position. The right and left shocks can be enclosed by the corresponding right and left base members such that the right and left shocks are substantially hidden from view.

Other embodiments of a wake tower for use with a boat are disclosed. The wake tower can include a right base member configured to be secured to the sports boat, a left base member configured to be secured to the sports boat, a right side bar extending upwardly from the right base member, a left side bar extending upwardly from the left base member, and a tow rope connector suspended generally between the right and left side bars. The tow rope connector can be configured to receive a tow rope.

The right and left side bars can be pivotally attached to the right and left base members using joints such that the wake tower can be pivoted between an upright position and a lowered position. The right and left side bars can include tubular piping defining interior chambers, and the joints can be disposed inside the interior chambers such that the joints are substantially hidden from view.

The right and left side bars can be pivotally attached to the right and left base members using swivel hinges. The right and left side bars are pivotally attached to the right and left base members using heim joints. The wake tower can include right and left shocks configured to bias the wake tower toward the upright position. The right and left shocks can be enclosed by the corresponding right and left base members such that the right and left shocks are substantially hidden from view.

DETAILED DESCRIPTION OF THE PREFERRED EMBODIMENT

Figure 1:
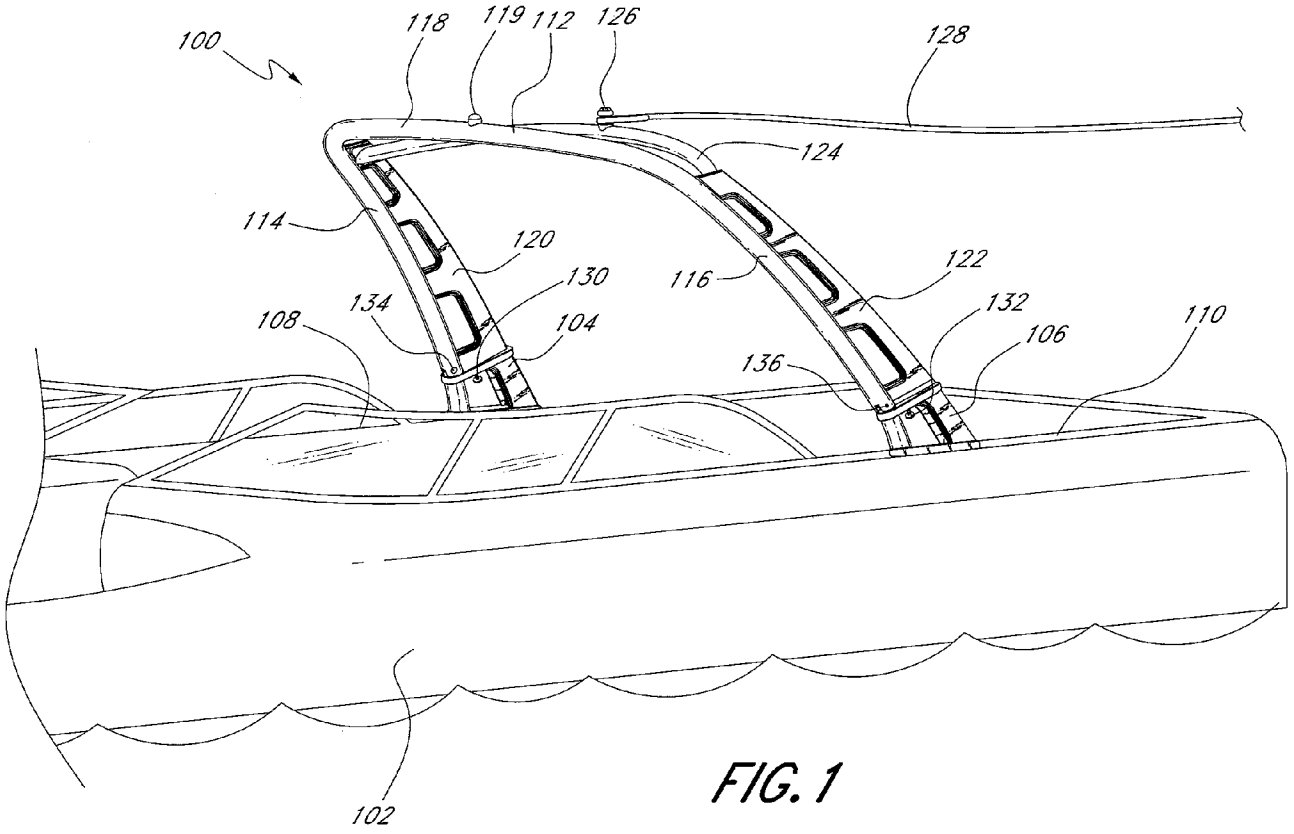
FIG. 1 is a perspective view of a wake tower attached to a powerboat.
Figure 2:
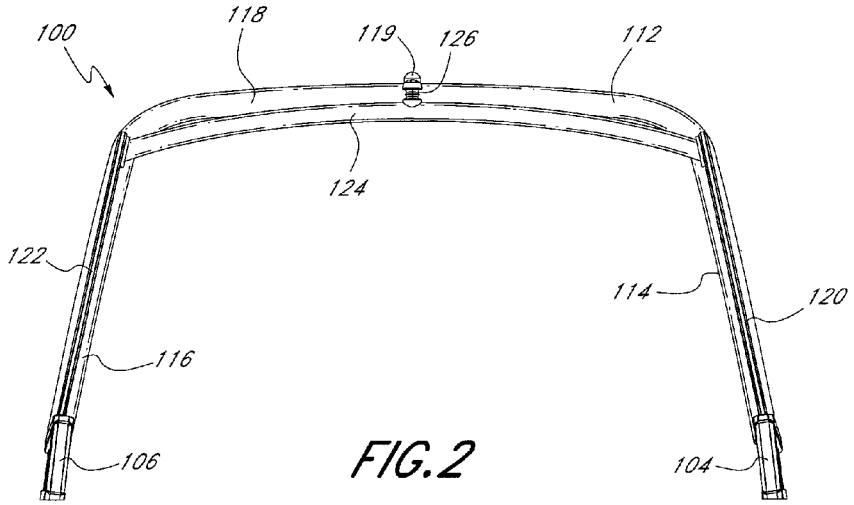
FIG. 2 is a rear view of the wake tower of FIG. 1.
Figure 3:
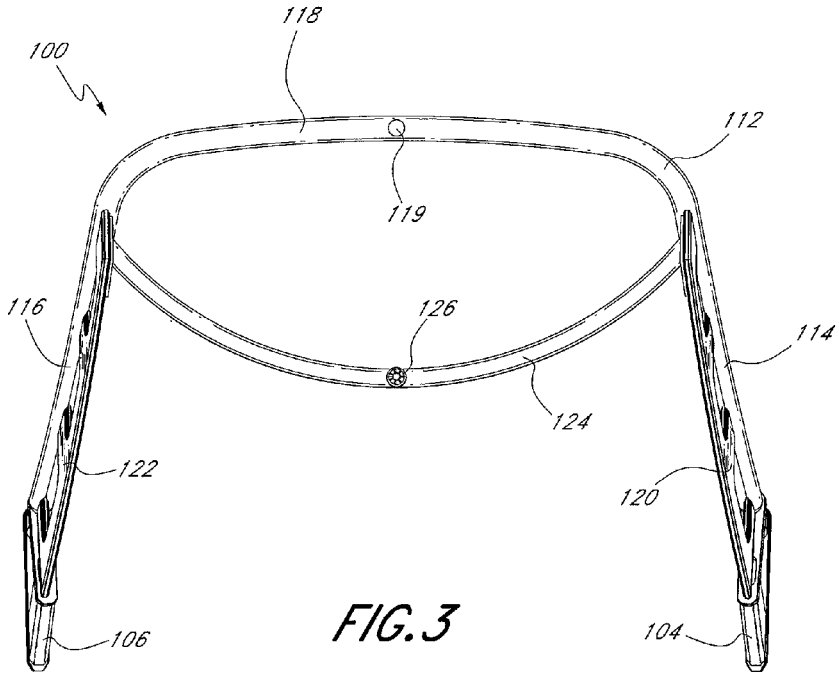
FIG. 3 is a top view of the wake tower of FIG. 1.

FIG. 1 is a perspective view of a wake tower 100 attached to a powerboat 102. FIG. 2 is a rear view of the wake tower 100. FIG. 3 is a top view of the wake tower 100. The powerboat can have a bow and a stern and a longitudinal axis running along the centerline of the powerboat 102 between the bow and the stern. The wake tower 100 can include a right base member 104 and a left base member 106 both configured to secure to the powerboat 102. In the illustrated embodiment, the right base member 104 is secured to the starboard gunwale 108 and the left base member 106 is secured to the port gunwale 110, although the base members 104, 106 can be secured to any other suitable portion of the powerboat 102. In some embodiments, base members 104, 106 can be configured to attach to the powerboat 102 at positions behind the driver's position such that the wake tower 100 does not obstruct the view of the driver. In some embodiments, the wake tower 100 includes only two connection regions or points between the wake tower 100 and the powerboat 102. In some embodiments, the wake tower 100 can be angled forward toward the bow of the powerboat 102, generally forming an acute angle with an upper plane of the boat frame.

A generally U-shaped bar 112 can extend generally upwardly from the base members 104, 106. The U-shaped bar 112 can include a right side bar portion 114, a left side bar portion 116, and a cross bar portion 118. A light 119, such as an all-round light, can be attached to the U-shaped bar 112, for example, at the highest point of the cross bar portion 118. Other components, which are not illustrated, can be attached to the cross bar 118 or to other parts of the wake tower 100 such as mirrors, speakers, flag holders, wakeboard racks, etc. The U-shaped bar 112 can be made of hollow tubular pipe having a diameter of at least about 2 inches and/or no more than about 5 inches, and in some instances having a diameter of about 3 inches, although diameters outside these ranges can also be used. The tubular pipe can have a generally circular cross sectional shape, or any other suitable cross sectional shape (e.g., generally oval, generally squared, etc.) The U-shaped bar 112 can be constructed of steel or aluminum or any other suitably rigid and lightweight material. The U-shaped bar 112 can be constructed from a single piece bent to the desired shape, or it can be constructed from a number of separately formed pieces (e.g., left bar, left curved connector, cross bar, right curved connector, and right bar) which can be combined to form the desired shape. In many embodiments, the U-shaped bar 112 can be generally hollow, but it can also be generally solid depending on the type of material used and the intended application.

A right support member 120 can extend along all or a portion of the length of the back side of the right side bar portion 114 facing the stern of the powerboat 102. Similarly, a left support member 122 can extend along all or a portion of the length of the back side of the left side bar portion 116. The right base member 104, right side bar portion 114, and right support member 120 can form a right region of the wake tower. The left base member 106, left side bar portion 116, and left support member 122 can form a left region of the wake tower. The support members 120, 122 can provide additional structural support to the U-shaped bar 112 to reduce the amount that the wake tower 100 shakes during use and to increase the maximum rearwardly directed towing load that the wake tower 100 is able to bear. In some embodiments, the wake tower 100 can be configured to withstand a maximum towing load of at least about 1000 pounds and/or no more than about 2000 or 2500 pounds, although maximum loads outside of these ranges are also possible. The support members 120, 122 can be made from aluminum or any other suitably rigid material, and in some embodiments the support members 120, 122 can be made of generally solid (e.g., generally non-hollow) construction to increase the strength and rigidity. In some embodiments, the support members 120, 122 can be made of machined billet aluminum.

A tow cross bar assembly 124 can extend between the right region and the left region of the wake tower 100 to suspend a tow rope connector 126 at an elevated position above the powerboat 102. For example, the tow cross bar assembly can be secured to the right and left support member 120, 122, or to any other suitable part of the right and left regions of the wake tower 100. A tow rope 130 can be attached to the tow rope connector 126 to be used to tow a wakeboarder, or other water sport participant. It will be understood that while many embodiments are discussed herein in connection with wakeboarding, the embodiments can also be used in many other contexts, such as with other water sports in which a participant is towed behind the powerboat 102, such as wakeskating, waterskiing, tubing, etc.

As can be seen in FIGS. 2 and 3, in some embodiments, the side bar portions 114, 116 can be angled vertically inwardly toward the medial plane of the powerboat 102 such that the cross bar portion 118 is shorter than the distance between the base members 104, 106. The side bar portions 114, 116 can be angled inward by at least about 10° and/or no more than about 20°, and in some embodiments by about 15° from vertical. Other configurations are possible. For example, the side bar portions 114, 116 can be directed substantially straight up from the base members 104, 106.

Figure 4:
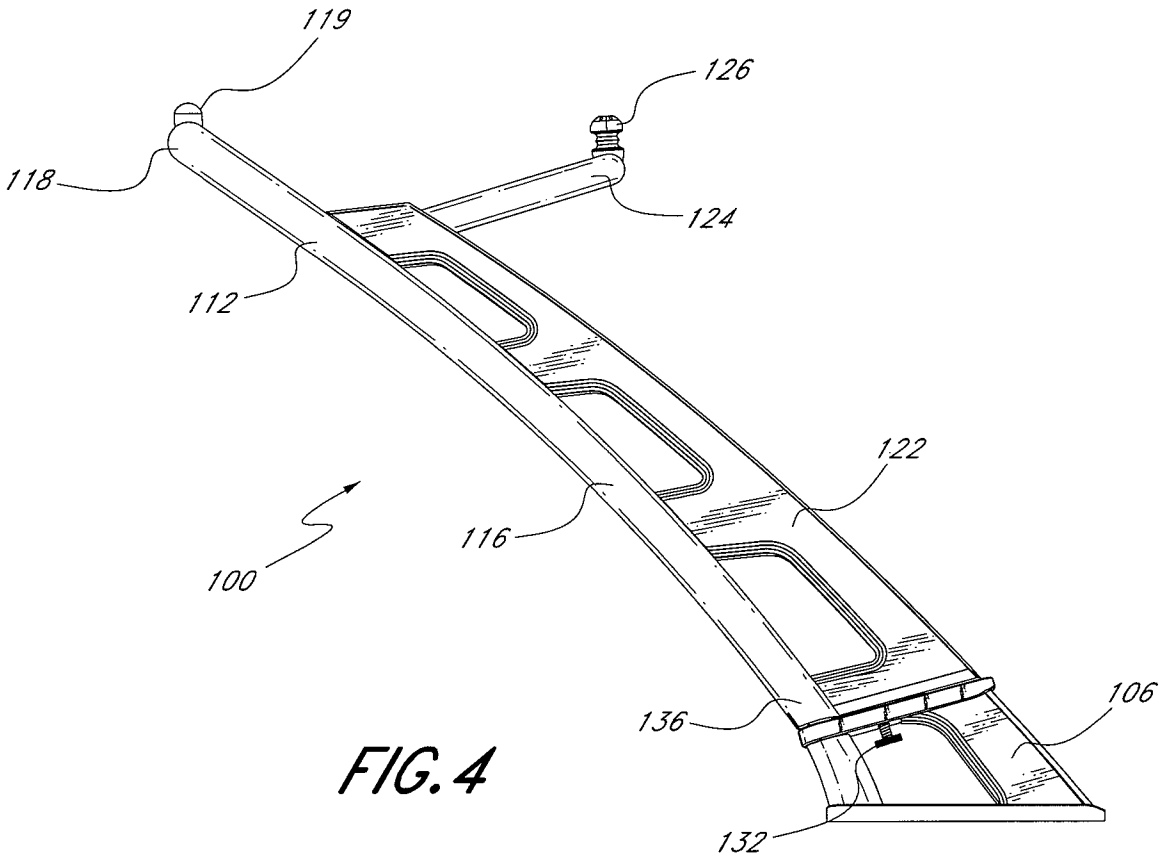
FIG. 4 is side view of the wake tower of FIG. 1 in an upright position.
Figure 5:
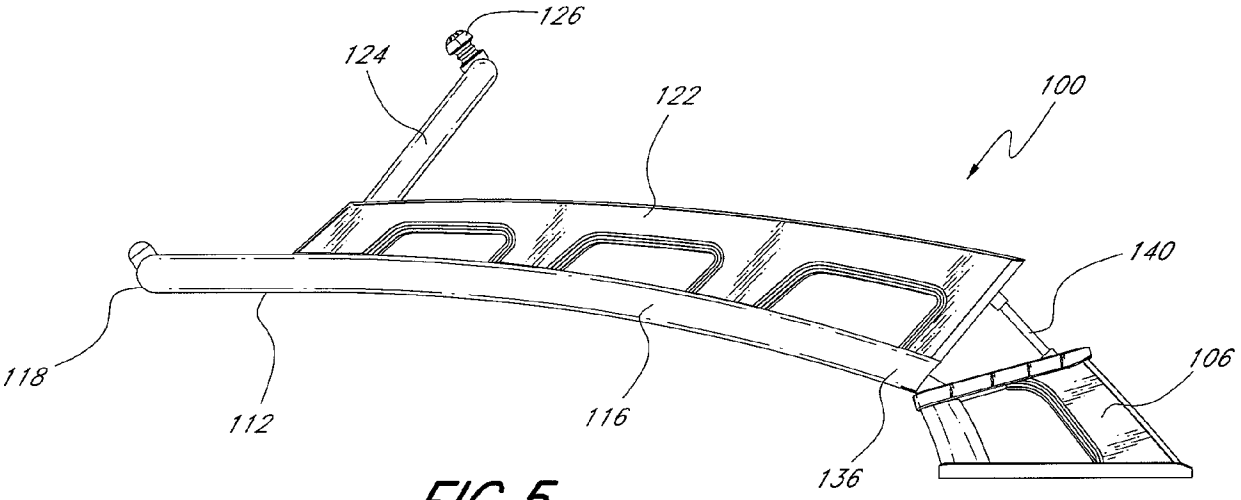
FIG. 5 is a side view of the wake tower of FIG. 1 in a lowered position.

In some embodiments, the wake tower 100 can be pivoted between an upright position and a lowered position. FIG. 4 is a side view of the wake tower 100 in the upright position. FIG. 5 is a side view of the wake tower 100 in the lowered position. With reference now to the wake tower 100 configured in the upright position, the light 119 can be positioned higher than the tow rope connector 126, and higher than any other portion of the wake tower 100. In some embodiments, the wake tower 100 can angle forward toward the bow by and angle of at least about 30° and/or no more than about 60°, and in some embodiments by and angle of about 45° from vertical. Thus, the tow rope connector 126 can be positioned closer to the bow of the powerboat 102 than the base members 104, 106. Other configurations are possible. For example, U-shaped bar 112 can extend substantially straight up from the base members 104, 106, or it can angle back toward the stern of the powerboat 102. In some embodiments, the support members 120, 122 can abut against the tops of the base members 104, 106 such that as a force is applied to the tow rope 128, the support members 120, 122 can bear against the base members 104, 106 to prevent the wake tower 100 from rotating back toward the stern of the powerboat 102, and to prevent the wake tower 100 from shaking under the applied force.

The wake tower 100 can be secured into the upright position by locking members, such as screws 130, 132. The left locking screw 132 can extend through a hole formed in the left base member 106 and can engage a threaded bore formed in the left support member 122. Thus, the left support member 122 can be secured to the left base member 106 to prevent the U-shaped bar 112 from pivoting toward the lowered position. Although hidden from view in FIG. 4, the right support member 120 can be secured to the right base member 104 using a right locking screw 130. The wake tower 100 can be secured into the upright position by using various other locking members, such as, for example, using clamps, or clasps, or pieces that extend from the base members 104, 106 to the corresponding support members 120, 122 and can be bolted to both.

The wake tower 100 can be transitioned to the lowered position (shown in FIG. 5), by removing the locking screws 130, 132 and pivoting the U-shaped bar 112 about the pivot points 134, 136 down toward the powerboat 102. In some embodiments, the U-shaped bar 112 can lower to a position where it is substantially horizontal. Various other lowered positions are possible depending on the size and configuration of the powerboat 102 with which the wake tower 100 is used. Thus, in some embodiments, the wake tower 100 can lower more or less than shown in the illustrated embodiments.

In some embodiments, the wake tower 100 can be biased toward the upright position such that the wake tower 100 is configured to resist being lowered to the lowered position. The biasing can be tuned so that it is not strong enough to pull the wake tower 100 up from the lowered position by itself, but the biasing can compensate for at least a portion, and in some embodiments a substantial portion, of the weight of the wake tower 100 to thereby allow a user to raise the wake tower 100 to the upright position using less effort than would otherwise be needed. The biasing can also facilitate the lowering of the wake tower 100 to the lowered position by allowing the user to support less weight while lowering the wake tower 100. In some embodiments, one or more dampening members, such as shocks, can be used. For example, a right shock 138 (hidden from view in FIG. 5) and a left shock 140 can be used to bias the wake tower toward the upright position. The shocks 138, 140 can be gas spring shocks, mechanical spring shocks, or any other suitable biasing mechanism.

Figure 6:
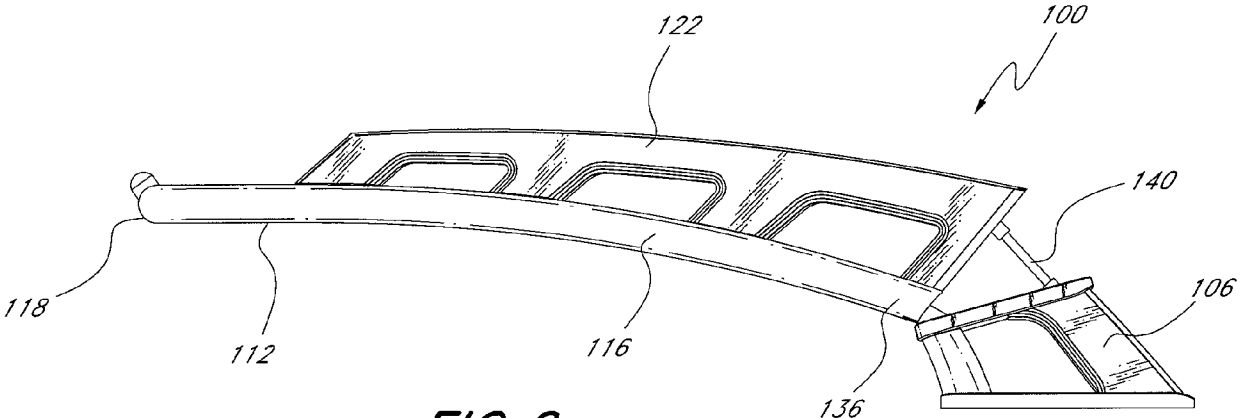
FIG. 6 is a side view of the wake tower of FIG. 1 in the lowered position with the tow cross bar removed.

In some embodiments, the wake tower 100 can have a lowered height of at least about 1 foot and/or no more than about 3 feet, and in some embodiments, about 2 feet, although other lowered heights outside of these ranges can also be used. In some embodiments, the tow cross bar assembly 124 can be removably attachable to the wake tower 100 (e.g., to the support members 120, 122). In some embodiments, the tow cross bar assembly 124 can be removed from the wake tower 100 to reduce the overall lowered height of the wake tower 100. FIG. 6 is a side view of the wake tower 100 in the lowered position with the tow cross bar assembly 124 removed.

Figure 7:
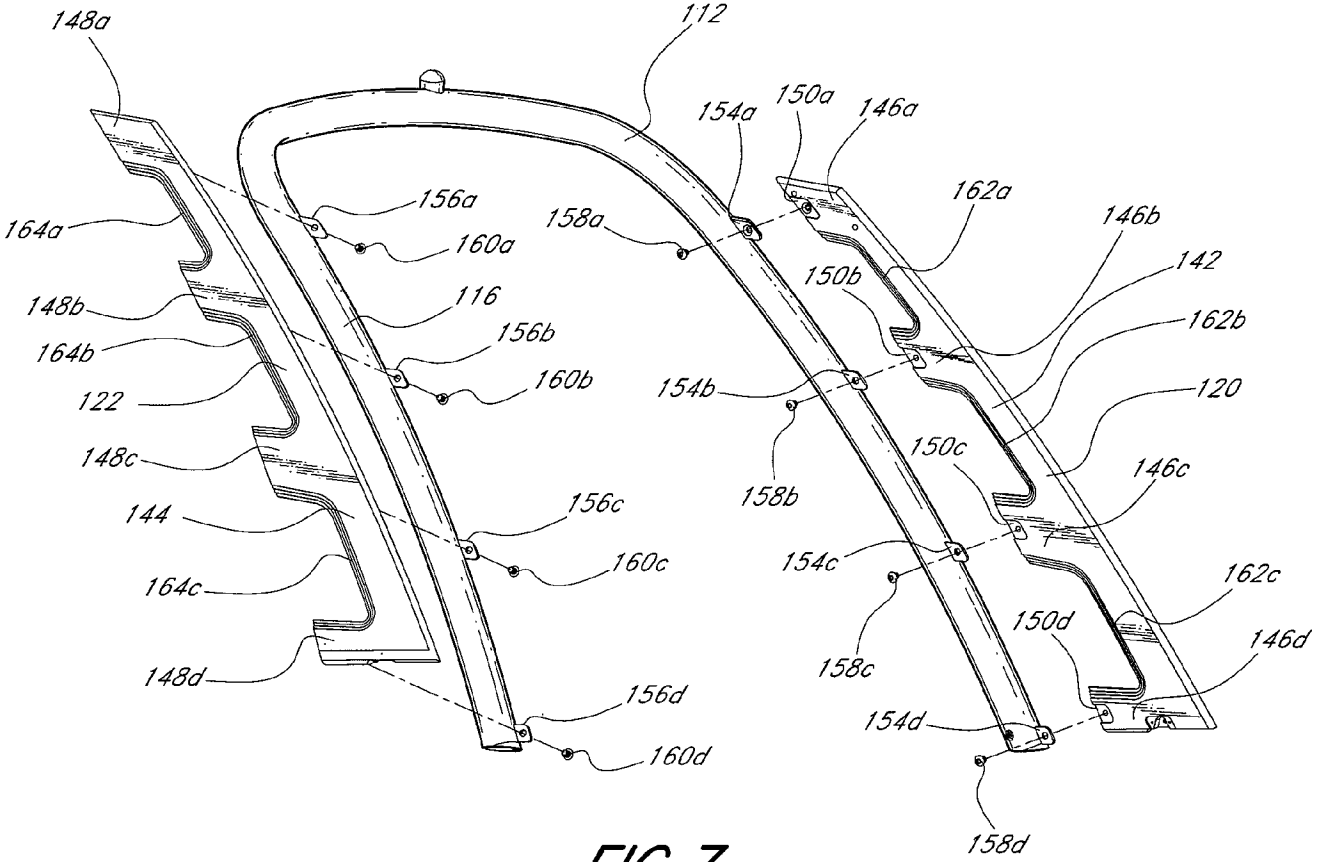
FIG. 7 is an exploded perspective view of the U-shaped bar and the support members of the wake tower of FIG. 1.
Figure 8:
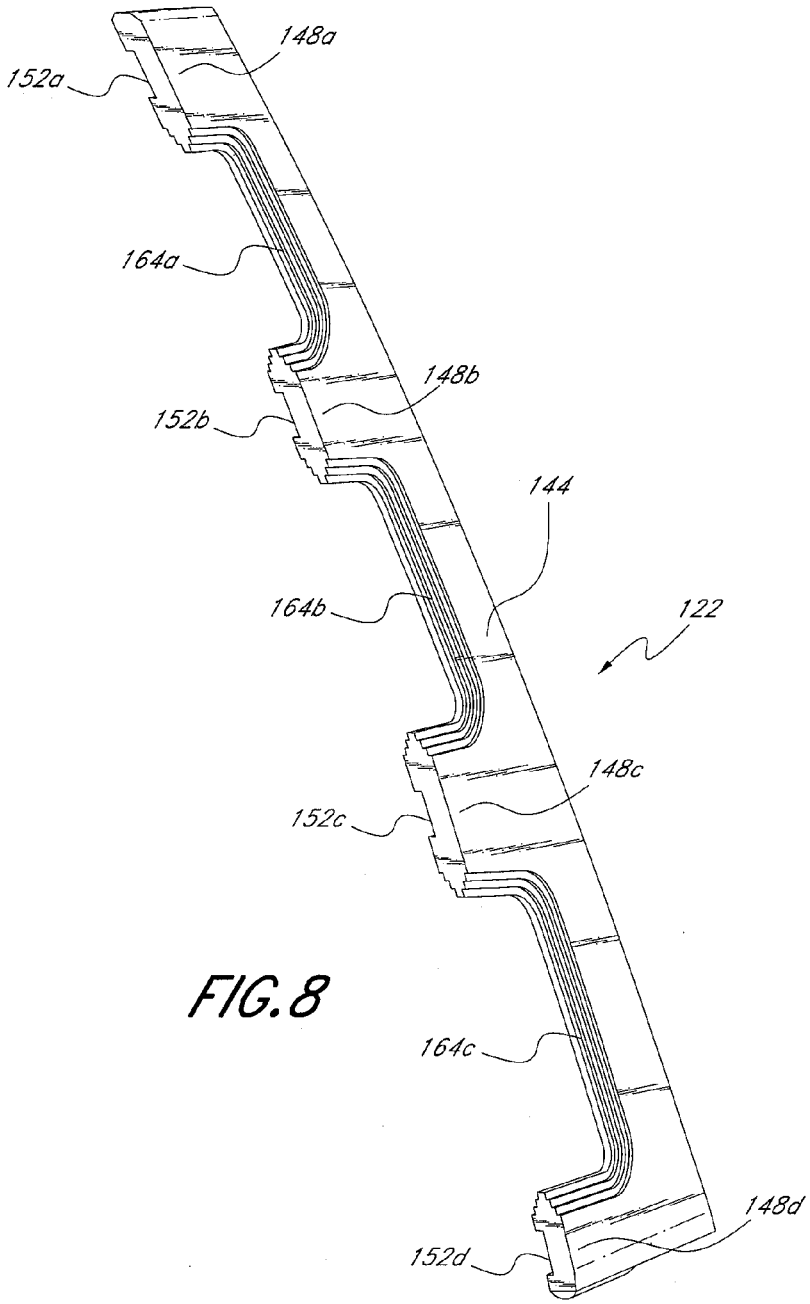
FIG. 8 is a perspective view of the left support member.
Figure 9:
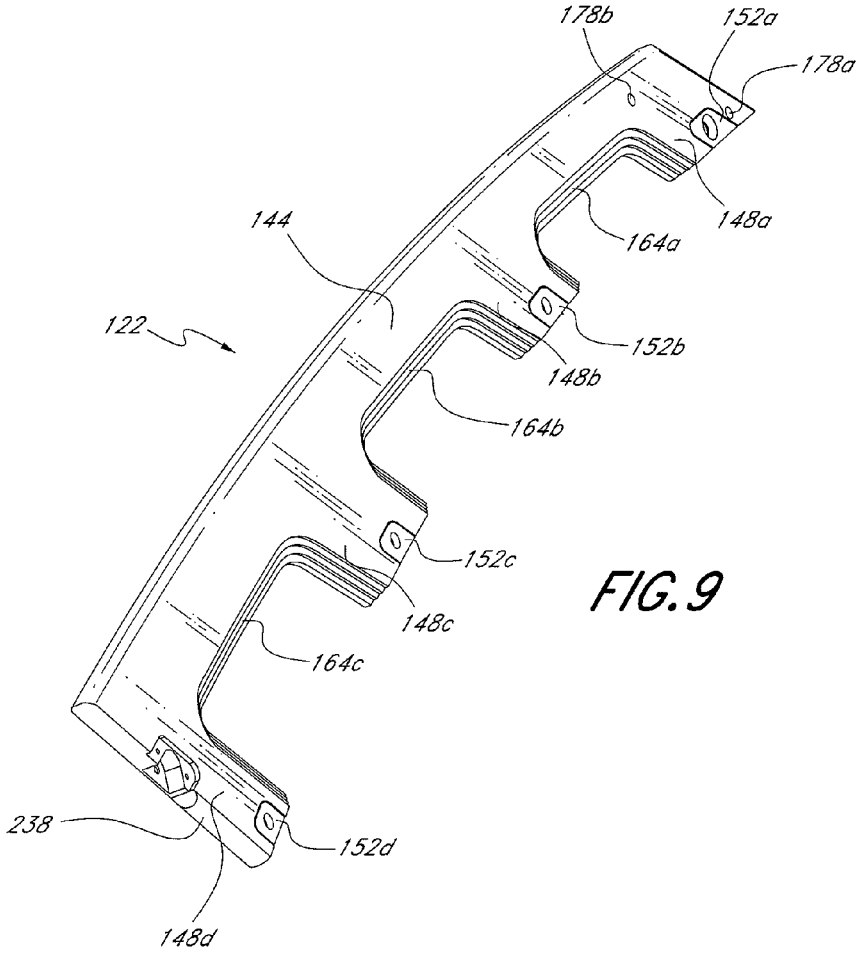
FIG. 9 is another perspective view of the left support member.

Further details of the support members 120, 122 including examples of methods for securing the support members 120, 122 to the side bars 114, 116 will be discussed with reference to FIGS. 7-9. FIG. 7 is an exploded perspective view of the wake tower 100. FIG. 8 is a perspective view of the left support member 122. FIG. 9 is another perspective view of the left support member 122. In some embodiments the right support member 120 can by symmetrically shaped and positioned such that the support members 120, 122 mirror one another.

The support members 120, 122 can include elongate support beams 142, 144 that can extend generally parallel to the corresponding side bars 114, 116. The elongate support beams 142, 144 can be slightly curved and can track substantially the same curvature as the side bars 114, 116. The support member 120, 122 can include arms 146*a-d*, 148*a-d* that extend from the elongate support beams toward the side bars 114, 116. The arms 146*a-d*, 148*a-d* can include a plurality of slots 150*a-d*, 152*a-d* formed at then ends thereof, and a plurality of threaded bores can be formed in the bases of the slots 150*a-d*, 152*a-d*. As illustrated, the front-facing edge of a support member can include a different curvature from the rear-facing edge, such that these edges tend to taper toward each other on the upper sides of the support members 120, 122. The support members 120, 122 can be shorter than the tubular structure, such that the top of each support member is spaced below the cross bar portion 118 and/or the tow cross bar assembly 124.

The U-shaped bar 112 can have a plurality of tabs 154*a-d*, 156*a-d* welded, or otherwise attached, to the back side of the side bars 114, 116. The tabs 154*a-d*, 156*a-d* can be configured to fit into the corresponding slots 150*a-d*, 152*a-d*. In some embodiments, the inside surfaces of the tabs 154*a-d*, 156*a-d* can sit flush with the inside surfaces of the corresponding arms 146*a-d*, 148*a-d* when inserted into the slots 150*a-d*, 152*a-d*. The tabs 154*a-d*, 156*a-d* can have holes formed therein. Right bolts 158*a-d* can pass through the holes formed in the right tabs 154*a-d* and can engage the right treaded bores formed in the right slots 150*a-d* to secure the right support member 120 to the right side bar 114. Left bolts 160*a-d* can pass through the holes formed in the left tabs 156*a-d* and can engage the left treaded bores formed in the left slots 152*a-d* to secure the left support member 122 to the left side bar 116. As illustrated, the one or more connection regions and connection structures between the side bars 114, 116 and support members 120, 122 can be positioned on the rear-facing portions of the side bars 114, 116 and the front-facing portions of the support members 120, 122. The support members 120, 122 can be attached to the side bars 114, 116 in any other suitable manner. For example, the support members 120, 122 can be welded directly to the side bars 114, 116. The ends of the arms 146*a-d*, 148*a-d* can be welded to corresponding portions of the side bars 114, e.g., near where the tabs 154*a-d*, 156*a-d* are shown in the illustrated embodiment. The support member 120, 122 can also be secured to the side bars 114, 116 using clamps or any other suitable securing mechanism.

In some embodiments, the tabs 158*a-d*, 160*a-d* can be substantially evenly spaced from each other. In some embodiments, the distance between adjacent arms 146*a-d*, 148*a-d* decreases from the bottom to the top. Other configurations are possible. In some embodiments, the four arms 146*a-d*, 148*a-d* and the four tabs 154*a-d*, 156*a-d* can provide four connection points between the support members 120, 122 and the corresponding side bars 114, 116. At least one opening can be formed between consecutive arms 146*a-d*, 148*a-d*. As illustrated, a plurality of openings (e.g., three) can be formed between the connection points. Other configurations are possible. In some embodiments the support members 120, 122 can include fewer arms (e.g., three arms, or two arms) or a greater number of arms (e.g., five arms or more). In some embodiments, the support members 120, 122 can have no arms and the openings that are shown in the illustrated embodiment can instead be filled with additional material (e.g., aluminum), such that the exterior surface of the support member is generally solid and generally continuous.

The support members 120, 122 can each include a plurality (e.g., three) sets of steps 162, 164 formed surrounding the openings formed between the arms 146*a-d*, 148*a-d*. In some embodiments, the sets of steps 162*a-c*, 164*a-c* can include a plurality of steps formed facing to the inside toward the longitudinal axis of the powerboat, and a plurality of steps formed facing to the outside away from the longitudinal axis of the powerboat.

Figure 10:
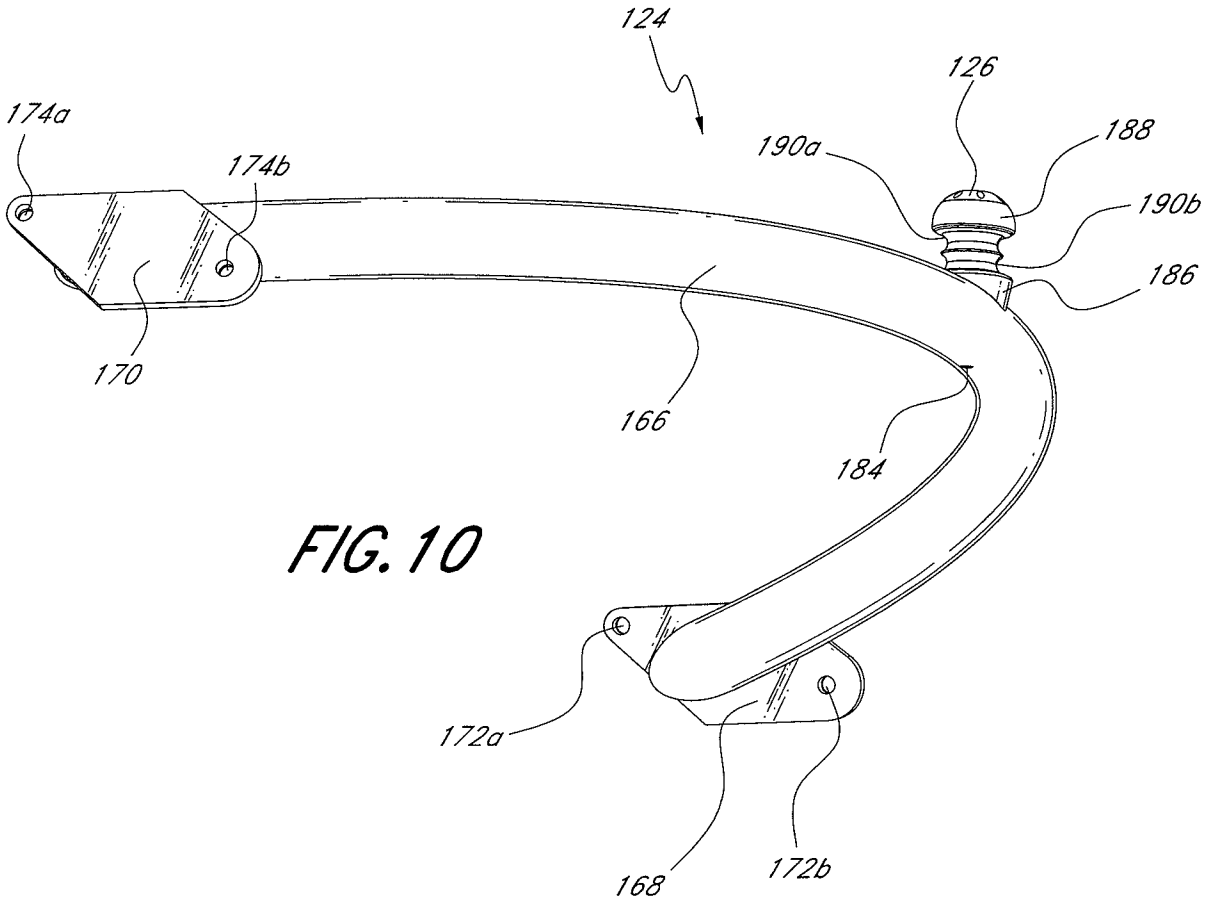
FIG. 10 is perspective view of the tow cross bar.
Figure 11:
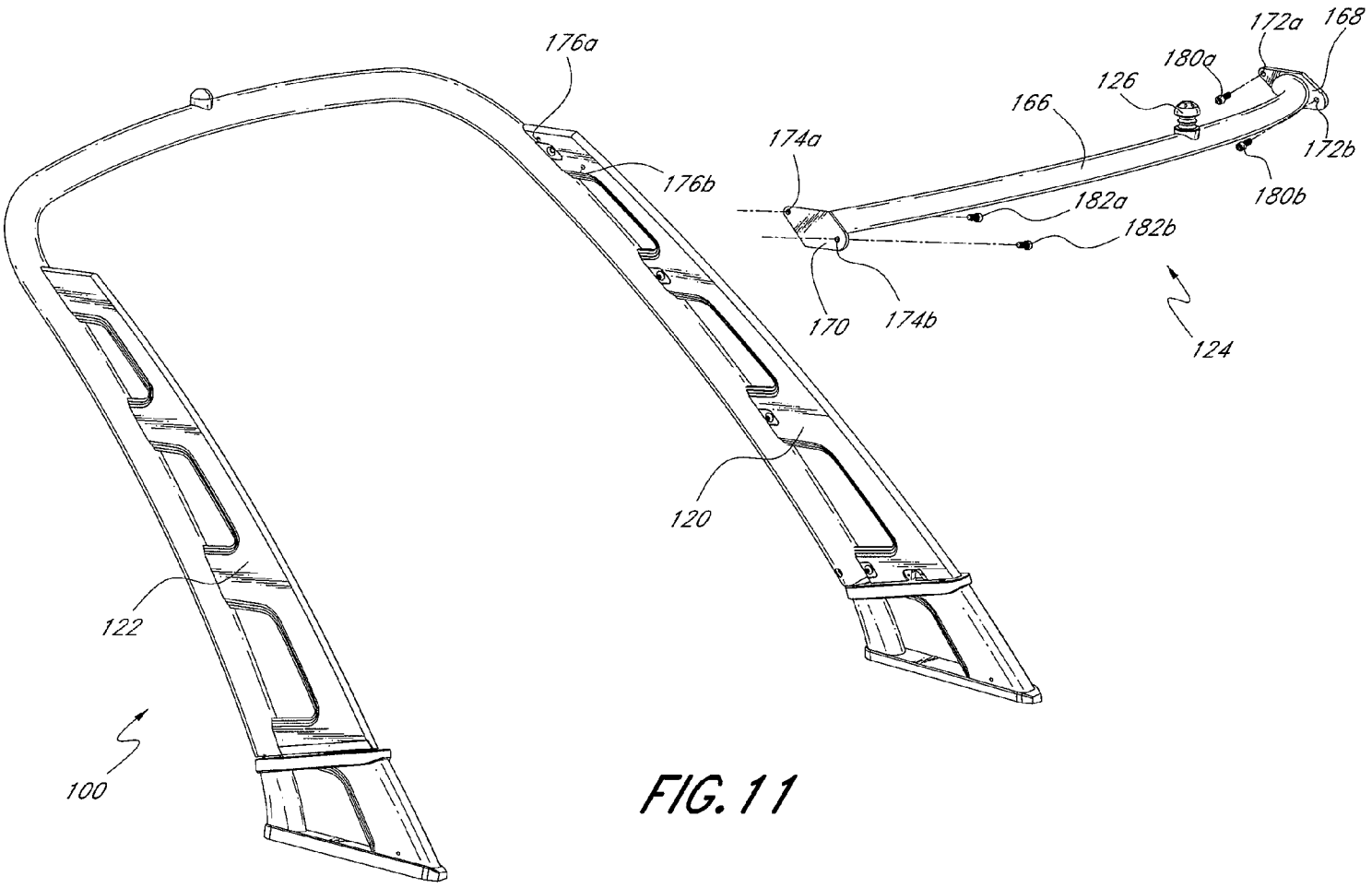
FIG. 11 is an exploded perspective view of the wake tower of FIG. 1 with the tow cross bar detached.

Further details of the tow cross bar assembly 124, including examples of methods for attaching the tow cross bar assembly 124 to the wake tower 100, will now be described in connection with FIGS. 10 and 11. FIG. 10 is a perspective view of the tow cross bar assembly 124. FIG. 11 is an exploded perspective view of the wake tower 100 showing the tow cross bar assembly 124 separated therefrom.

The tow cross bar assembly 124 can include a generally horizontal bar 166, which can be curved toward the stern of the powerboat. Right and left side plates 168, 170 can be welded, or otherwise attached, to the ends of the bar 166. Holes 172*a-b*, 174*a-b* can be formed in the respective right and left end plates 168, 170. As shown in FIGS. 9 and 11, the support members 120, 122 can include threaded bores 176*a-b*, 178*a-b*. Right bolts 180*a-b* can pass through the corresponding holes 172*a-b* in the right end plate 168 and engage the right threaded bores 176*a-b* to secure the right side of the tow cross bar assembly 124 to the right support member 120. Left bolts 182*a-b* can pass through the corresponding holes 174*a-b* in the left end plate 170 and engage the left threaded bores 178*a-b* to secure the left side of the tow cross bar assembly 124 to the left support member 122. In some embodiments, the tow cross bar 124 can be attached to the left and right side bars 114, 116 instead of, or in addition to, the support members 120, 122. In some embodiments, the tow cross bar 124 can function to stabilize the wake tower 100, e.g., to reduce the amount of lateral vibration, swinging, or shaking of the wake tower 100 during use. The tow cross bar 124 can function as a supporting member (e.g., as a gusset) for the sides of the wake tower 100.

The tow rope connector 126 can be removably secured to the center of the bar 166, for example, using a pin, or bolt that passes up through an opening 184 formed in the bottom of the bar 166. Alternatively, the tow rope connector 126 can be welded to the bar 166 or secured thereto in any other suitable manner. The tow rope connector 126 can include a base 186, and a head 188. One or more channels 190*a-b* can be formed between the base 186 and the head 188 for receiving an end of a tow rope. In the illustrated embodiment, the tow rope connector 126 can include a plurality (e.g., two) channels 190*a-b* divided by a ridge.

Figure 12:
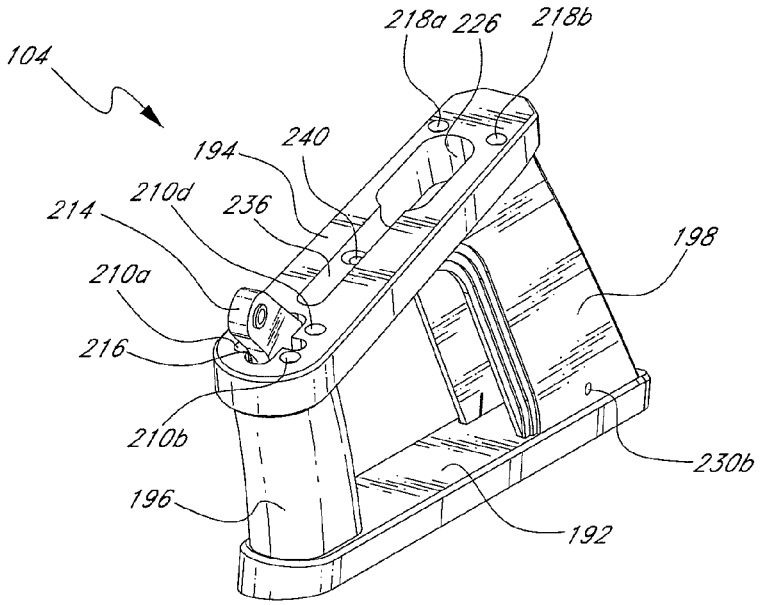
FIG. 12 is a perspective view of the right base member.
Figure 13:
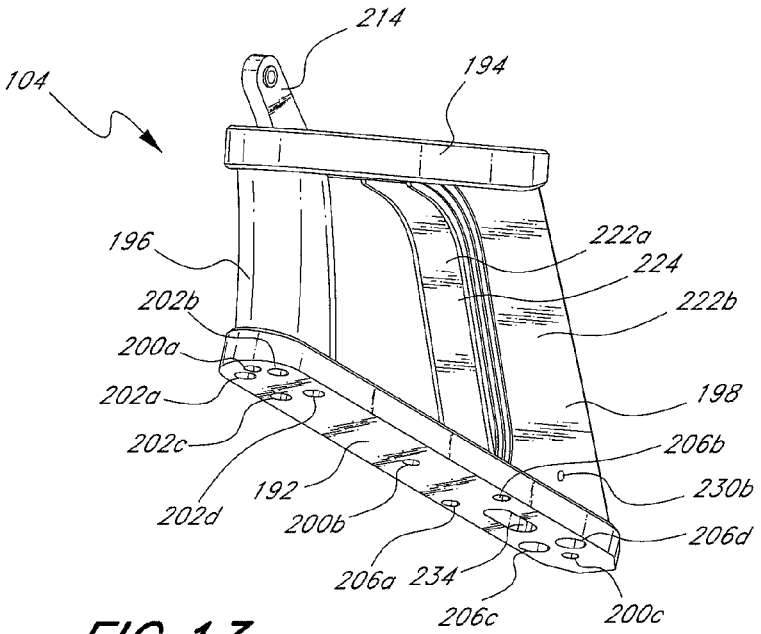
FIG. 13 is another perspective view of the right base member.
Figure 14:
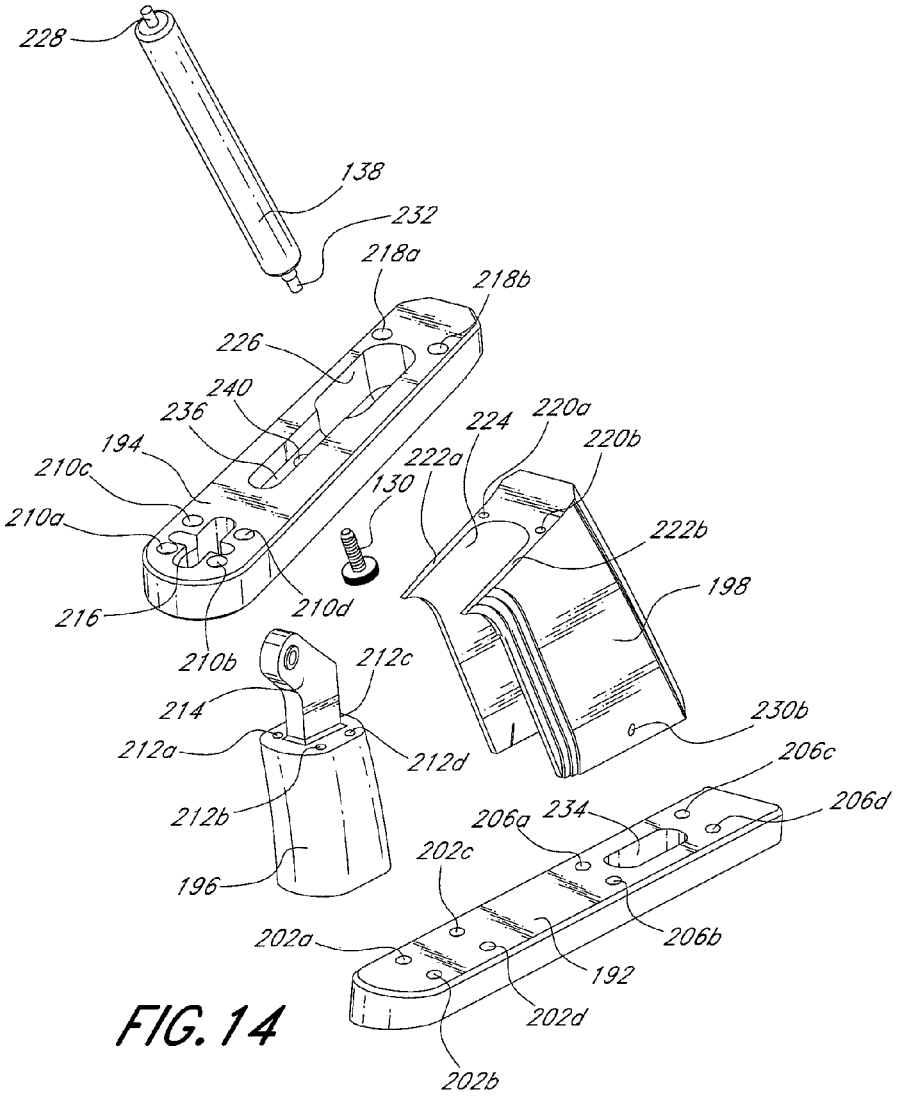
FIG. 14 is an exploded perspective view of the right base member.
Figure 15:
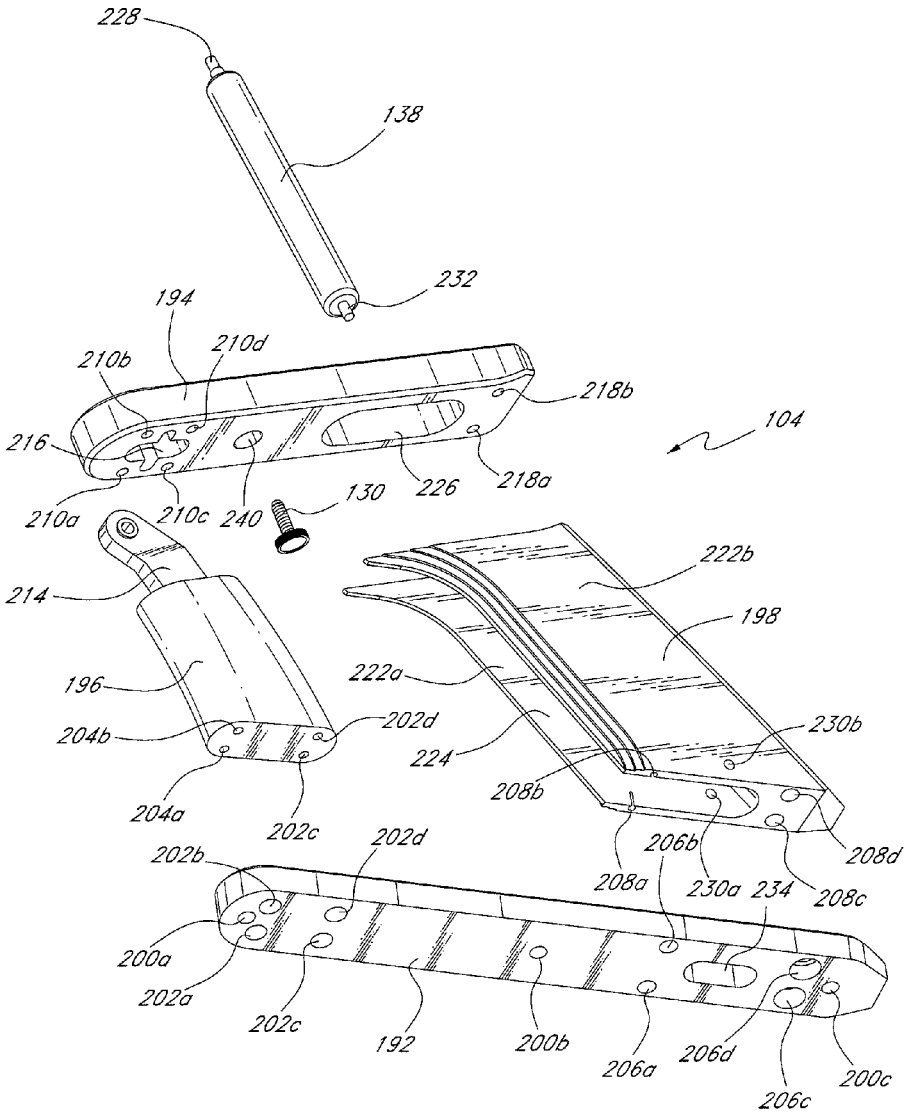
FIG. 15 is another exploded perspective view of the right base member.

FIG. 12 is a perspective view of the right base member 104 in an assembled configuration. FIG. 13 is another perspective view of the right base member 104 in the assembled configuration. FIG. 14 is an exploded perspective view of the right base member 104. FIG. 15 is another exploded perspective view of the right base member 104. The left base member 106 can have similar (e.g., mirrored) construction as the right base member 104.

The right base member 104 can include a base plate 192 and a top plate 194. A front member 196 can extend between the base plate 192 and top plate 194 at the front ends thereof, and a back member 198 can extend between the base plate 192 and top plate 194 at the rear ends thereof. As illustrated, in some embodiments the back member 198 can be substantially longer than the front member 196 so as to orient the base plate 192 in a generally downwardly sloping position from back to front, thereby permitting the tower 100 to be forwardly tilted in the secured, upright position. The base plate can include bores 200*a-c* formed in the bottom surface and can be threaded to receive bolts (not shown) for securing the base plate 192 to the powerboat (e.g., to the gunwale). In some embodiments, the bores 200*a-c* extend only partially through the base plate 192, although through holes can also be used.

The base plate 192 can include holes 202*a-d* configured to align with bores 204*a-d* formed in the bottom of the front member 196. The bores 204*a-d* can be threaded to receive bolts (not shown) that pass through the holes 202*a-d* to secure the front member 196 to the base plate 192. Holes 206*a-d* in the base plate 192 can align with bores 208*a-d* formed in the bottom of the rear member 198. The bores 208*a-d* can be threaded to receive bolts (not shown) that pass through the holes 206*a-d* to secure the rear member 198 to the base plate 192.

The top plate 194 can include holes 210*a-d* configured to align with bores 212*a-d* formed in the top surface of the front member 196. The bores 212*a-d* can be threaded to receive bolts (not shown) that pass through the holes 210*a-d* to secure the top plate 194 to the front member 196. A securing member, such as an arm 214 can extend upward from the top surface of the front member 196, and the arm 214 can pass through an opening formed through the top plate such that the arm 214 extends upward past the top surface of the top plate 194. The arm 214 can be used in securing the U-shaped bar 112 to the base member 104 as described in greater detail elsewhere herein. The top plate 194 can include holes 218*a-b* that can be configured to align with bores 220*a-b* formed in the top of the rear member 198. The bores 220*a-b* can be threaded to receive bolts (not shown) that pass through the holes 218*a-b* to secure the top plate 194 to the rear member 198. It will be understood that different numbers of holes and bores than those shown in the illustrated embodiment can be used to assemble the base plate 192, top plate 194, front member 196, and rear member 198.

The rear member 198 can include one or more sidewalls 222*a-b* that generally or entirely surround a cavity 124 formed therein or therebetween. As illustrated, the rear member 198 can have a generally U-shaped cross sectional shape. The cavity 124 can be configured to house a dampening member, such as a right shock 138. An opening 226 can be formed in the top base plate 192 to allow the top end 228 of the shock 138 to extend through the top plate 194 so that the top end 228 of the shock 138 can be secured to the support member 220 as described elsewhere herein. Holes 230*a-b* can extend through the side walls 222*a-b* near the bottom thereof, and a bolt (not shown) can pass through the holes to engage the bottom end 232 of the shock 138 and secure the bottom end 232 of the shock 138 to the rear member 198. In some embodiments, the shock 138 can be pivotally secured to the rear member 198 so that the shock 138 can pivot in a generally forward direction when the wake tower 100 is transitioned between the upright and lowered positions. Other configurations are possible. For example, the bottom end 232 of the shock 138 can be secured to the base plate 192, or the bottom end 232 of the shock 138 can pass through an opening 234 formed in the base plate 192 to secure to the powerboat (e.g., to the gunwale).

Figure 16:
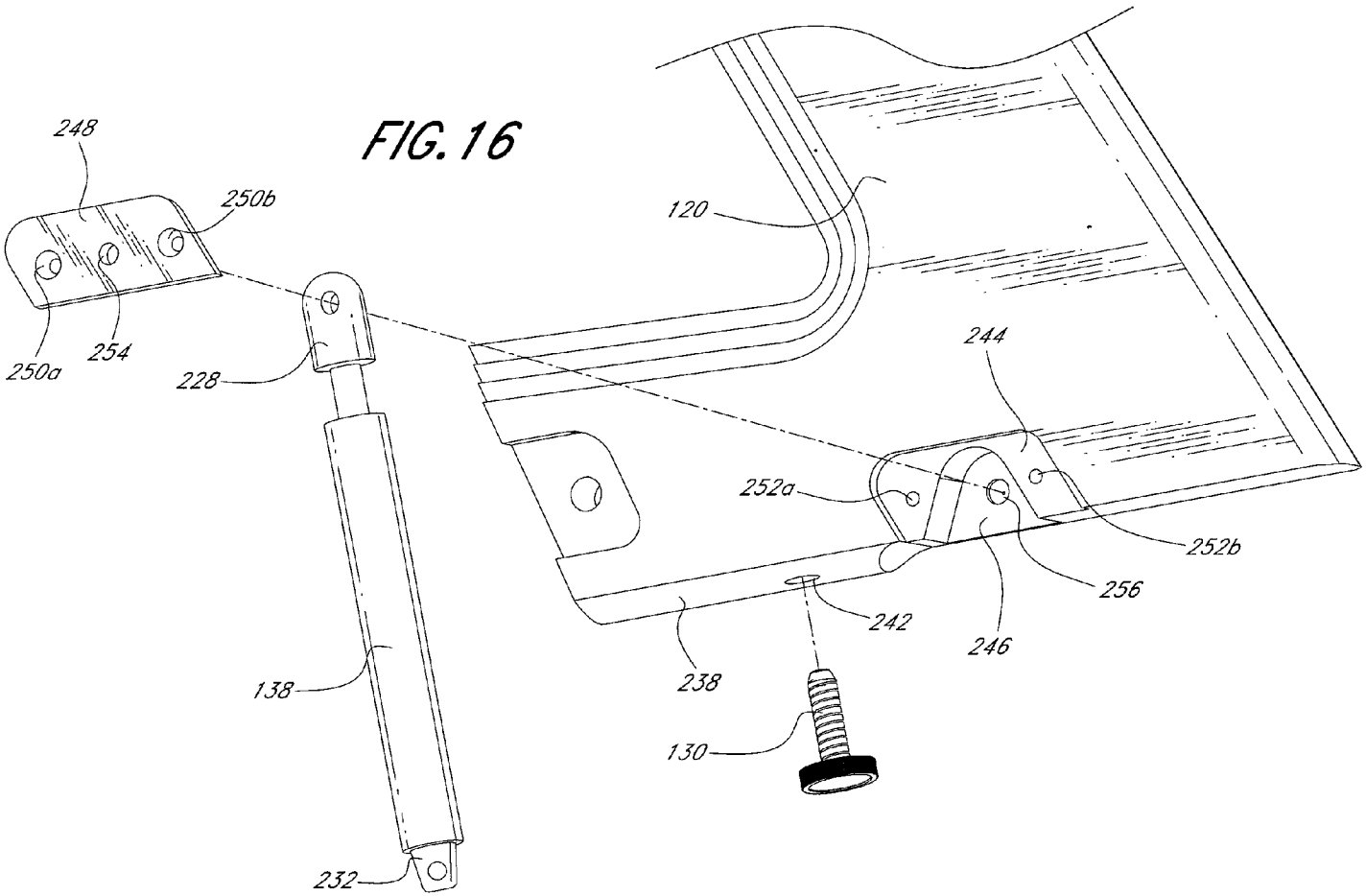
FIG. 16 is an exploded partial perspective view of the right support member and the right shock.

With continued reference to FIGS. 12-15, and with reference also to FIG. 16, the top plate 194 can include a depression 236 that extends partially through the top plate 194 and that runs from the opening 226 toward the opening 216. The depression 236 can have a curved shape to receive a curved protrusion 238 formed on the bottom of the support member 120 (shown in FIG. 16). A hole 240 can be formed in the base of the depression 236 to allow a locking screw 130 to pass through the top plate 194 and engage a threaded bore 242 formed in the bottom of the support member 120 (e.g., formed in the protrusion 238). The locking screw 130 can be used to secure the support member 120 to the base member 104 to lock the wake tower 100 in the upright position. The locking screw 130 can be removed to allow the support member 120 to pivot away from the base member 104 as the wake tower 100 is transitioned to the lowered position.

The support member 120 can include a slot 244 formed on the inside surface (facing inward toward the longitudinal axis of the powerboat). A pivot region, such as a depression 246, can be formed in a generally central area of the slot 244. The depression 246 can be configured to receive the top end 228 of the shock 138. The depression 246 can be generally wedge-shaped to allow the top end 228 of the shock 138 to pivot therein as the wake tower 100 is transitioned between the upright and lowered positions. As illustrated, in some embodiments the pivot region can include a first side that is oriented closer to the vertical plane than is a second side to permit further pivoting toward the second side. The top end 228 of the shock 138 can be secured to the support member 120 using a plate 248. The plate 248 can be shaped to fit into the slot 244 and the inside surface of the plate 248 can sit flush with the inside surface of the support member 120. The plate can include side holes 250*a-d* configured to align with bores 252*a-b* formed in the slot 244. Bolts (not shown) can pass through the side holes 250*a-b* and engage the bores 252*a-b* to secure the plate 248 to the slot 244. The plate 248 can include a center hole 254 configured to align with the hole formed in the top end 228 of the shock 138 and to also align with a center bore 256 formed in the depression 246. A bolt (not shown) can pass through the center hole 254, through the hole formed in the top end 228 of the shock 138, and engage the bore 256, thereby pivotally securing the top end 228 of the shock 138 to the support member 120.

Figure 17:
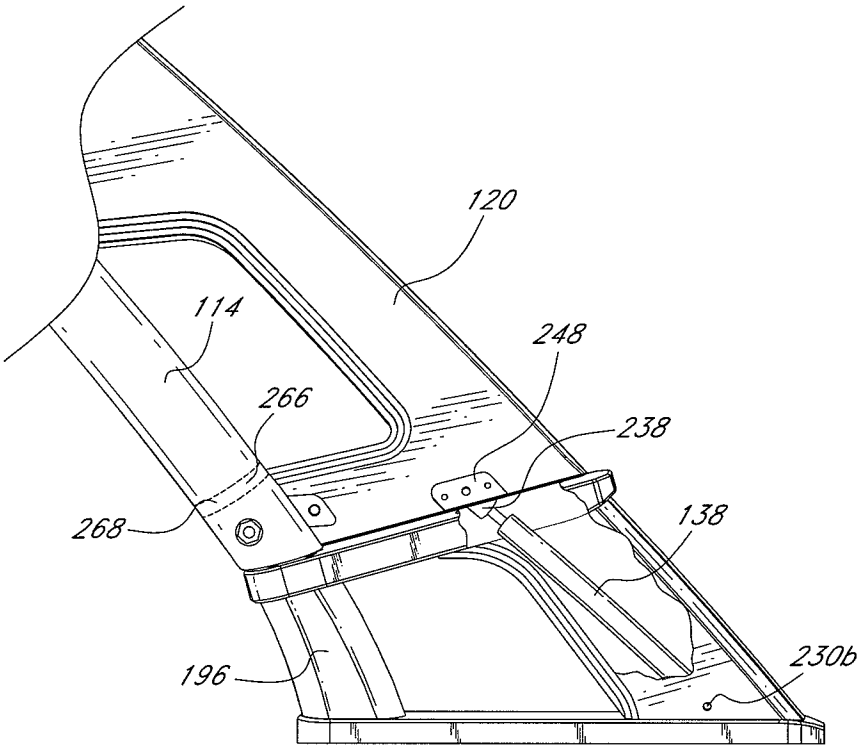
FIG. 17 is a partial side view of the wake tower of FIG. 1 in the upright position with a portion of the right base member cutaway.
Figure 18:
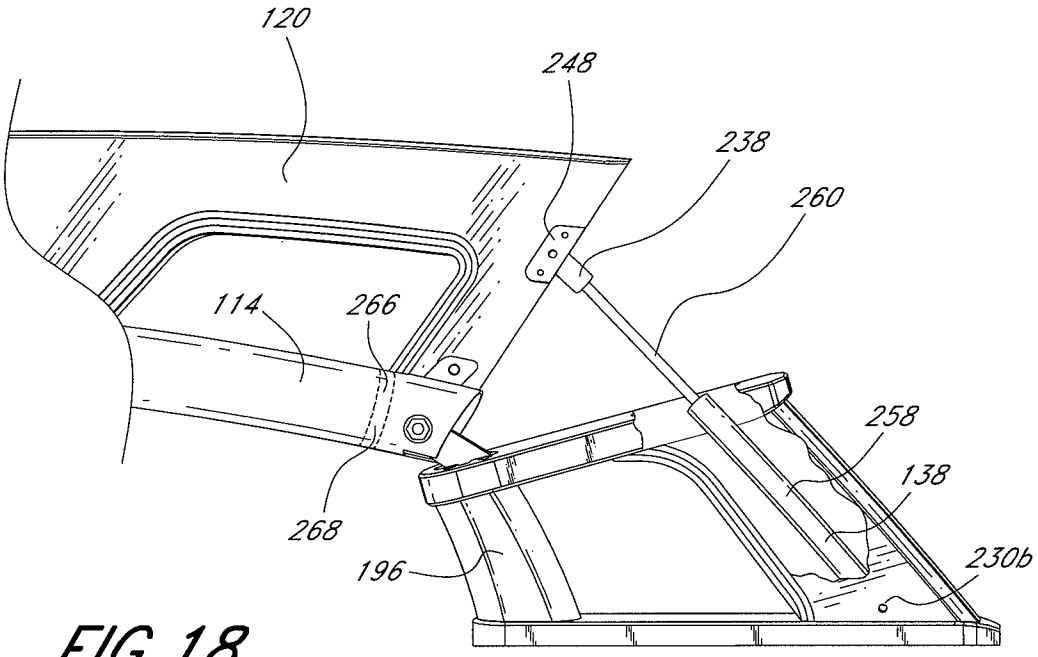
FIG. 18 is a partial side view of the wake tower of FIG. 1 in the lowered position with a portion of the right base member cutaway.

FIG. 17 is partial side view of the wake tower 100 in the upright position with a portion of the base member 104 cutaway to show the shock 138. FIG. 18 is a partial side view of the wake tower 100 in the lowered position with a portion of the base member 104 cut away to show the shock 138. The bottom end 232 of the shock 138 can be pivotally secured to the base member 104 (e.g., using a bolt through hole 230*b*). The top end 228 of the shock 138 can be pivotally secured to the support member 120 (e.g., using a bolt through the plate 248). As can be seen by comparing FIGS. 17 and 18, the shock 138 can pivot slightly between the upright and lowered positions such that the shock 138 tilts further forward (toward the front member 196) when the wake tower 100 is in the upright position. For example, in some embodiments the shock 138 can pivot at least about 5° and/or no more than about 10°, and in some embodiments by about 7.5°.

The shock 138 can include a body 258 and a shaft 260 slideably received within the body 258 such that the shaft 258 can slide between a withdrawn position (as shown in FIG. 17) and an extended position (as shown in FIG. 18). The shaft 260 can be biased toward the withdrawn position so that the wake tower 100 is biased toward the upright position. The shock 138 can include a compressible/expandable gas, a mechanical spring, or any other mechanism for biasing the shaft 260 toward the withdrawn position. The shock 138 can provide a biasing force of at least about 100 pounds and/or no more than about 250 pounds, and in some embodiments, at least about 150 pounds and/or no more than about 200 pounds. Biasing forces outside of these ranges can also be used, depending on the weight of the wake tower 100 and the desired amount of resistance against pivoting toward the lowered position. In some embodiments, the biasing force can be insufficient to raise the wake tower 100 from the lowered position to the upright position on its own. However, the biasing force can compensate for a portion of the weight of the wake tower 100 making it substantially easier for a user to lift or lower the wake tower 100.

Figure 19:
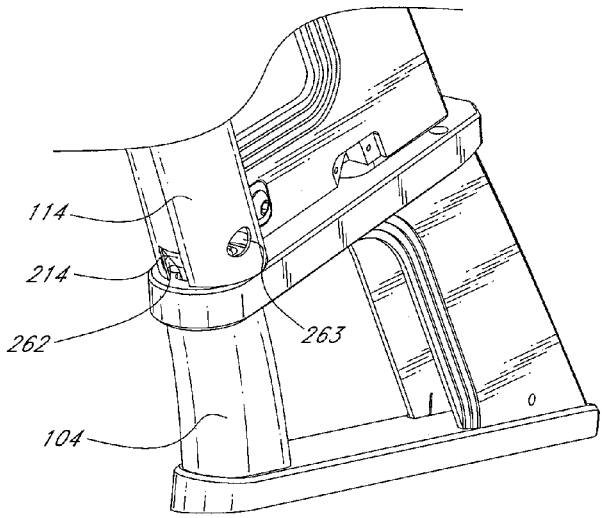
FIG. 19 is a partial perspective view of the area of the wake tower of FIG. 1 near the right base member.

FIG. 19 is a partial perspective view of the portion of the wake tower 100 near the right base member 104. The right side bar 114 can be pivotally secured to the base member 104. The arm 214 of the base member 104 can extend through the base of the right side bar 114 and into the hollow area inside the pipe. The arm 214 can be pivotally secured to the right side bar as described in greater detail elsewhere herein. The base of right side bar 114 can include a notch 262 formed in the front side thereof. The notch 262 can be configured such that when the side bar 114 is rotated to the lowered position, the arm 214 of the base member 104 can be received into the notch 262, so that the arm 214 does not abut against the inside surface of the right side bar 114 and prevent the wake tower 100 from lowering. Also shown in FIG. 19, the side bar 114 can include a hole 263 formed in the side thereof to allow a screwdriver or other tool to be inserted through the hole 263 to access a joint assembly 264 disposed inside the side bar 114.

The side bar 114 can pivot with respect to the base member 104 using a joint assembly. In some embodiments, a simple hinging joint capable of rotating about a single axis can be used. However, in some embodiments, the joint assembly can have more than just a single axis of rotation to account for the side bar 114 being tapered inward toward the longitudinal axis of the boat. In some embodiments, a swivel hinge can be used. In some embodiments, a ball joint can be used. In some embodiments, a heim joint (or a rode end bearing) can be used.

Figure 20:
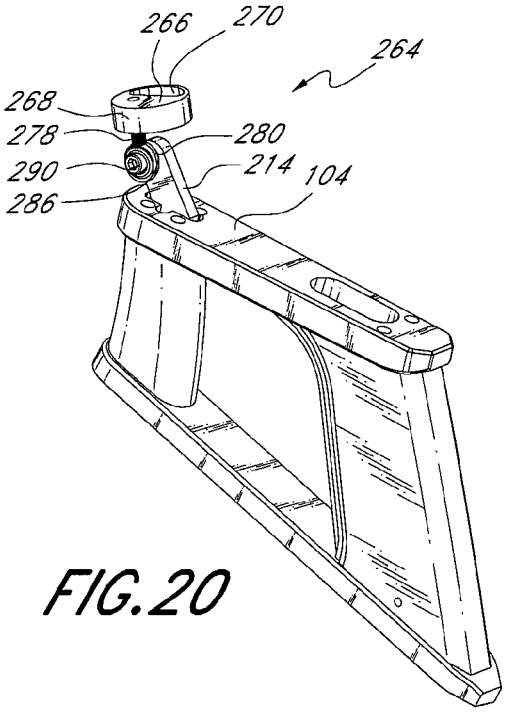
FIG. 20 is a perspective view of a portion of the right base member with a joint assembly attached thereto.
Figure 21:
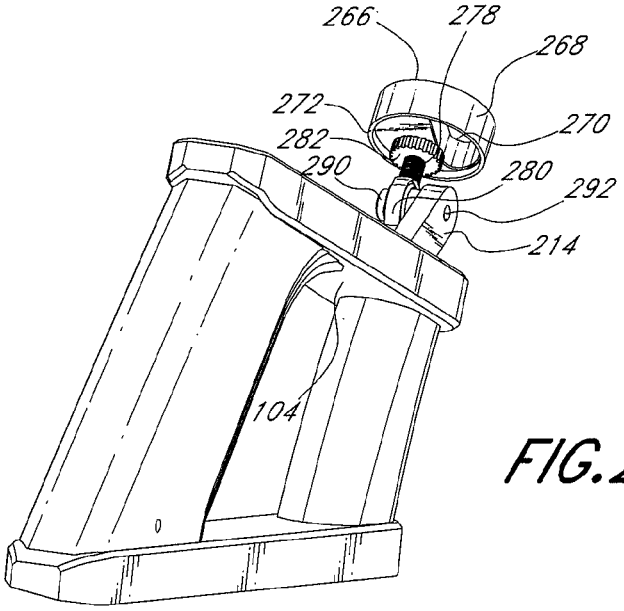
FIG. 21 is another perspective view of a portion of the right base member with the joint assembly of FIG. 20 attached thereto.
Figure 22:
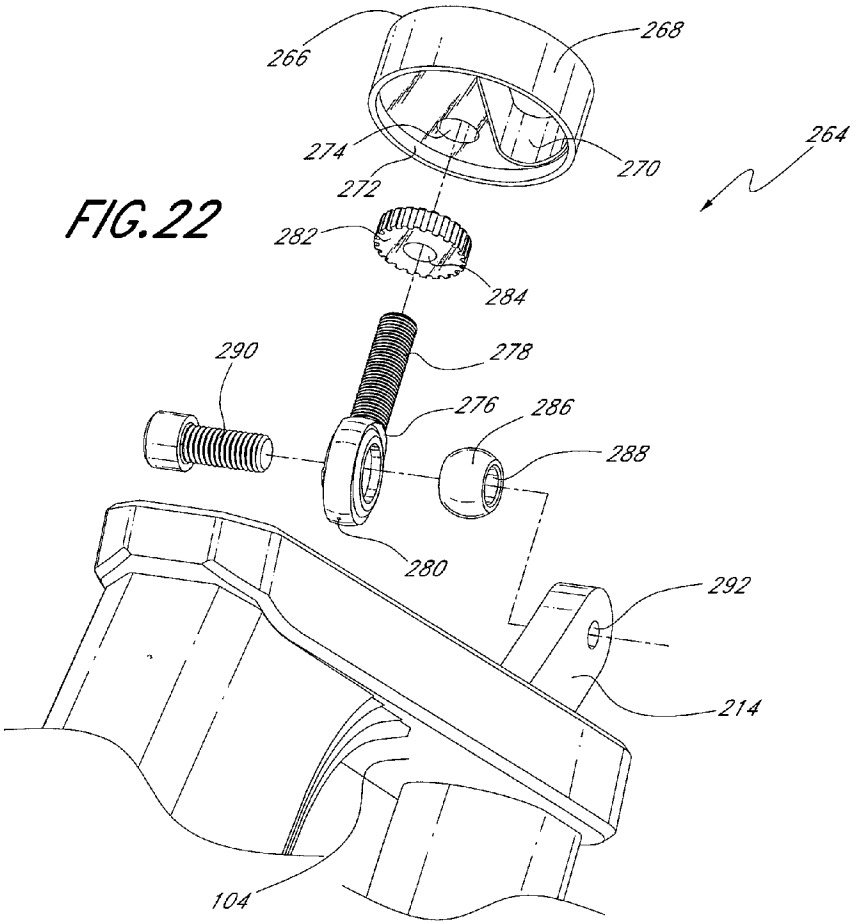
FIG. 22 is an exploded perspective view of a portion of the right base member with the joint assembly of FIG. 20 attached thereto.
Figure 23:
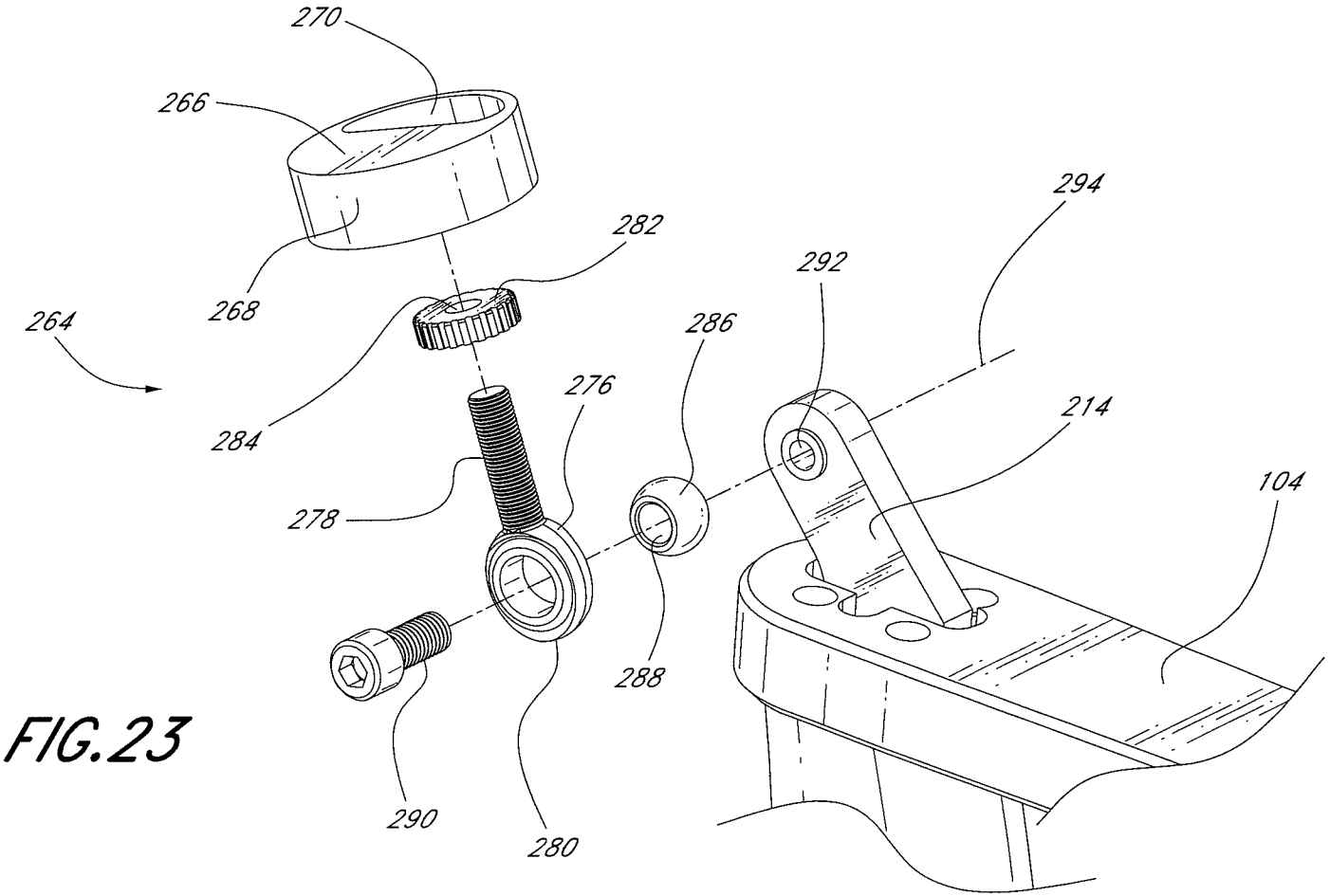
FIG. 23 is another exploded perspective view of a portion of the right base member with the joint assembly of FIG. 20 attached thereto.
Figure 24:
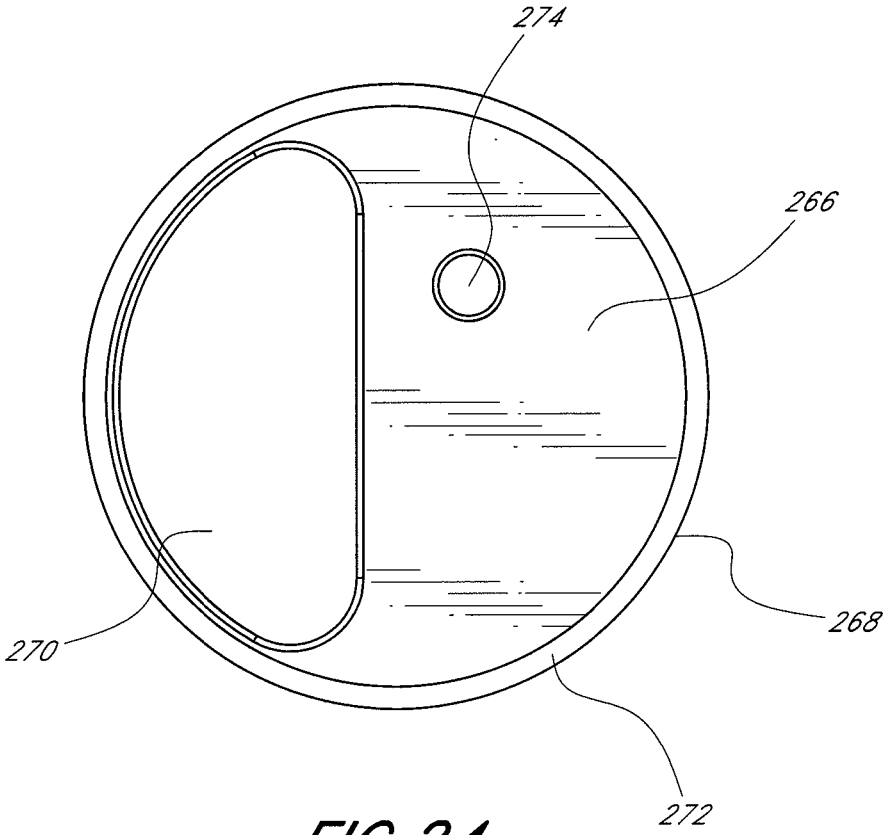
FIG. 24 is a bottom view of the disk member of the joint assembly of FIG. 20.

FIG. 20 is a perspective view of a portion of the base member 104 with a joint assembly 264 attached to the arm 214. FIG. 21 is another perspective view of a portion of the base member 104 with a joint assembly 224 attached to the arm 214. FIG. 22 is an exploded perspective view of a portion of the base member 104 and the joint assembly 264. FIG. 23 is another exploded perspective view of a portion of the base member 104 and the joint assembly 264. The joint assembly 264 can include a supporting member, such as a disk member 266. The disk member 266 can be generally cylindrical in shape, and can have an outer peripheral surface 268 shaped to fit into the hollow inside of the side arm 114. The outer peripheral surface 268 of the disk member 266 can be welded, or otherwise secured, to the inside surface of the side arm 114. The position of the disk member 266 inside the side bar 114 is shown in FIGS. 17 and 18 by dotted lines outlining the outer peripheral surface 268 of the disk member 266. The disk member 266 can include an opening 270 which can allow air or fluid to exit the hollow side bar 114. In some embodiments, the underside of the disk member 266 can be inset forming a lip 272 around periphery of the bottom surface. A bore 274 can be formed in the underside of the disk member 266. The bore 274 can be formed at a position that is offset from the center of the disk member 266, as shown in FIG. 24. The bore 274 can extend fully or only partially through the disk member 266.

The joint assembly 264 can include a casing bolt 276 that can include a threaded shaft 278 and a ring casing 280. The bore 274 can be threaded to engage the threaded shaft 278 directly thereby securing the casing bolt 276 to the disk member 266. By twisting the casing bolt 276 and causing more or less of the shaft 278 to engage the bore 274, the height by which the disk member 266 is separated from the base member 104 can be adjusted. Thus, the position of the side bar 114 (which is attached to the disk member 266) can be adjusted slightly by controlling the amount by which the shaft 278 is inserted into the bore 274. For example, the side bar 114 can be maintained elevated slightly from the base member 104 forming a gap therebetween.

In some embodiments, the bore 274 can slideably receive the shaft 278 therein and an adjustment member, such as disk 282 can be used to adjust the distance that the shaft 278 extends into the bore 274. The adjustment disk 282 can have a threaded hole 284 formed through the center thereof for engaging the threaded shaft 278 of the casing bolt 276. The adjustment disk 282 can be secured to the underside of the disk member 266 such that the adjustment disk 282 can rotate about the hole 284 with respect to the disk member 266. By rotating the adjustment disk 282 in a tightening direction, the shaft 278 can be advance into the bore 274 and the disk member 266 can be brought closer to the base member 104 without rotating the casing bolt 276 or the disk member 266. By rotating the adjustment disk 284 in a loosening direction, the shaft 278 can be extracted from the bore 274 and the disk member 266 can be pushed further from the base member 104 without rotating the casing bolt 276 or the disk member 266. The adjustment member 282 can include cerrations or other gripping structures along at least a portion of its circumference or periphery to facilitate gripping during rotation. Thus, in some embodiments, the position of the disk member 266, and the side bar 114 attached thereto, can be adjusted when the wake tower 100 is assembled. In embodiments in which the shaft 278 directly engages the bore 274, the adjustment disk 282 can be omitted. In some embodiments, the disk 282 can be used as a locking nut to facilitate the securing of the casing bolt 276 to the disk member 266.

The joint assembly can include a ball swivel 286 which can be generally spherical in shape with a hole 288 through the center thereof. A bolt 290 can pass through the hole of the ring casing 280, through the hole 288 in the ball swivel 286, and engage a threaded bore 292 formed in the arm 214. In some embodiments, the bore 292 is not threaded and the bolt 290 can pass through the bore 292 to engage a nut on the opposite side of the arm 214. In some instances, such as when a bolt is described herein as engaging a threaded bore, the bolt can instead pass through the bore to engage a nut on the opposite side. The ring casing 280 can side on the surface of the ball swivel 286 such that the shaft 278 can point in various different directions. For example, the shaft 278 can be rotated about the axis 294 and it can also be rotated slightly in the direction orthogonal to the axis 294 (e.g., to point inward slightly toward the longitudinal axis of the powerboat). Thus, the joint assembly 264 can provide more rotational freedom than a simple hinge that rotates about a single axis. Thus, the joint assemblies can allow the side bars 114, 116 to rotate between the upright and lowered positions while the side bars 114, 116 taper inward toward the longitudinal axis of the powerboat.

Although many features of the embodiments shown in the Figures are specifically called out and described, it will be understood that additional features, dimensions, proportions, relational positions of elements, etc. shown in the drawings are intended to make up a part of this disclosure even when not specifically called out or described. It will also be understood that the specific dimensions, proportions, relational positions of elements, etc. can be varied from those shown in the illustrated embodiments.

Embodiments have been described in connection with the accompanying drawings. However, it should be understood that the foregoing embodiments have been described at a level of detail to allow one of ordinary skill in the art to make and use the devices, systems, etc. described herein. A wide variety of variation is possible. Various components and elements may be altered, added, removed, or rearranged. While certain embodiments have been explicitly described, other embodiments will also be apparent to those of ordinary skill in the art based on this disclosure. Therefore, the scope of the invention is intended to be defined by reference to the claims and not simply with regard to the explicitly described embodiments.

The following is claimed:

1. A wake tower for use with a boat, the wake tower comprising:

a right region comprising:

a right base member configured to be secured to the boat;

a right side bar extending generally upwardly from the right base member, the right side bar comprising the right side bar;

a right joint that pivotally attaches the right base member to the right side bar; and a right shock having a first end attached to the right base member and a second end extending into the interior chamber of the right side bar and attached to the right side bar;

a left region comprising:

a left base member configured to be secured to the boat;

a left side bar extending generally upwardly from the left base member, the left side bar comprising an interior chamber inside of the left side bar;

a left joint that pivotally attaches the left base member to the left side bar, wherein the right joint and the left joint enable the wake tower to pivot between an upright position and a lowered position; and a left shock having a first end attached to the left base member and a second end extending into the interior chamber of the left side bar and attached to the left side bar, wherein the right and left shocks are configured to compensate for at least a portion of the weight of the wake tower to facilitate manually raising and lowering the tower;

a top cross bar extending between a top of the right side bar and a top of the left side bar to form an inverted U-shaped structure; and a tow rope connector assembly including a tow rope connector suspended generally between the right region and the left region, the tow rope connector configured to receive a tow rope, wherein the tow rope connector assembly has a first state in which the tow rope connector is suspended generally above the inverted U-shaped structure of the tower when the tower is in the lowered position, and wherein the tow rope connector assembly has a second state in which the tow rope connector is not positioned above the inverted U-shaped structure of the tower when the tower is in the lowered position, to reduce the height of the tower in the lowered position.

2. The wake tower of claim 1, wherein the right joint comprises a swivel hinge and wherein the left joint comprises a swivel hinge.

3. The wake tower of claim 1, wherein the right joint comprises a heim joint and wherein the left joint comprises a heim joint.

4. The wake tower of claim 1, wherein the wake tower is configured to pivot towards a bow of the boat to transition from the upright position to the lowered position.

5. The wake tower of claim 1, wherein at least portions of the right and left shocks are positioned in the corresponding right and left base members such that the right and left shocks are substantially hidden from view when the wake tower in the upright position.

6. The wake tower of claim 1, wherein at least one of the right base member and the left base member comprises a top of the base member having a downward slope from back to front.

7. The wake tower of claim 1, wherein:

the right side bar comprises tubular piping and a right support member extending along at least a portion of the tubular piping of the right side bar to provide structural support to the right side bar; and the left side bar comprises tubular piping and a left support member extending along at least a portion of the tubular piping of the left side bar to provide structural support to the left side bar.

8. The wake tower of claim 1, wherein the tow rope connector assembly is removably coupled to the inverted U-shaped structure, and wherein the tow rope connector assembly in the second state is removed from the inverted U-shaped structure.

9. The wake tower of claim 7, wherein the tow rope connector assembly comprises a cross bar that attaches to the right and left support structures, and wherein the tow rope connector is attached to the cross bar.

10. A wake tower for use with a boat, the wake tower comprising:

a right base member configured to be secured to the boat;

a left base member configured to be secured to the boat;

an inverted U-shaped structure extending from the right base member to the left base member, the inverted U-shaped structure comprising:

a right side portion extending generally upward from the right base member;

a left side portion extending generally upward from the left base member; and an upper portion extending between the right side portion and the left side portion;

a right joint that couples the right side portion to the right base member;

a left joint that couples the left side portion to the left base member, wherein the right and left joints are configured such that the inverted U-shaped structure is movable relative to the right and left base members between an upright position and a lowered position; and a tow rope connector assembly comprising:

a tow rope connector configured to receive a tow rope; and a positioning element configured to position the tow rope connector generally between the right side portion and the left side portion;

wherein the tow rope connector assembly has a first configuration in which the positioning element extends generally upward from the inverted U-shaped structure when the tower is in the lowered position such that the tow rope connector is positioned above the inverted U-shaped structure; and wherein the tow rope connector assembly has a second configuration in which the tow rope connector is not positioned above the inverted U-shaped structure when the tower is in the lowered position, to reduce the height of the tower in the lowered position.

11. The wake tower of claim 10, further comprising:

a right shock having a first end attached to the right base member and a second end attached to the right side portion of the inverted U-shaped structure; and a left shock having a first end attached to the left base member and a second end attached to the left side portion of the inverted U-shaped structure;

wherein the right and left shocks are configured to compensate for at least a portion of the weight of the wake tower to facilitate manually raising and lowering the tower.

12. The wake tower of claim 10, wherein the inverted U-shaped structure is configured to extend forward toward a bow of the boat when the tower is in the upright position, wherein the tow rope connector is positioned rearward of the upper portion of the inverted U-shaped structure when the tower is in the upright position, and wherein the inverted U-shaped structure pivots forward toward the bow of the boat to transition from the upright position to the lowered position.

13. The wake tower of claim 10, wherein the tow rope connector assembly is removably coupled to the inverted U-shaped structure, and wherein the tow rope connector assembly is removed from the inverted U-shaped structure in the second configuration.

14. The wake tower of claim 10, wherein the right side portion of the inverted U-shaped structure comprises a right tubular piping section and a right support member that extends along at least a portion of the right tubular piping section to provide structural support, and wherein the left side portion of the inverted U-shaped structure comprises a left tubular piping section and a left support member that extends along at least a portion of the left tubular piping section to provide structural support.

15. The wake tower of claim 14, wherein the positioning element of the tow rope connector assembly comprises a cross bar that attaches to the right and left support members of the inverted U-shaped structure.

16. A wake tower for use with a boat, the wake tower comprising:

a right base member configured to be secured to the boat;

a left base member configured to be secured to the boat;

an inverted U-shaped structure extending from the right base member to the left base member, the inverted U-shaped structure comprising:

a right side portion extending generally upward from the right base member;

a left side portion extending generally upward from the left base member; and an upper portion extending between the right side portion and the left side portion;

a right joint that couples the right side portion to the right base member;

a left joint that couples the left side portion to the left base member, wherein the right and left joints are configured such that the inverted U-shaped structure is movable relative to the right and left base members between an upright position and a lowered position, wherein the inverted U-shaped structure is configured to extend forward toward a bow of the boat when the tower is in the upright position, and wherein the inverted U-shaped structure pivots forward toward the bow of the boat to transition from the upright position to the lowered position;

a right biasing element having a first end attached to the right base member and a second end attached to the right side portion of the inverted U-shaped structure;

a left biasing element having a first end attached to the left base member and a second end attached to the left side portion of the inverted U-shaped structure, wherein the right and left biasing elements are configured to compensate for at least a portion of the weight of the wake tower to facilitate manually raising and lowering the tower; and a tow rope connector configured to receive a tow rope, the tow rope connector positioned generally between the right side portion and the left side portion.

17. The wake tower of claim 16, comprising a tow rope connector assembly that includes the tow rope connector and a positioning element configured to position the tow rope connector generally between the right side portion and the left side portion, wherein the tow rope connector assembly has a first configuration in which the positioning element extends generally upward from the inverted U-shaped structure when the tower is in the lowered position such that the tow rope connector is positioned above the U-shaped structure, and wherein the tow rope connector assembly has a second configuration in which the tow rope connector is not positioned above the U-shaped structure when the tower is in the lowered position, to reduce the height of the tower in the lowered position.

18. The wake tower of claim 16, wherein the right biasing element comprises at least one shock and wherein the left biasing element comprises at least one shock.

19. The wake tower of claim 16, wherein the right side portion of the inverted U-shaped structure comprises a right tubular piping section and a right support member that extends along at least a portion of the right tubular piping section to provide structural support, and wherein the left side portion of the inverted U-shaped structure comprises a left tubular piping section and a left support member that extends along at least a portion of the left tubular piping section to provide structural support.

20. A wake tower for use with a boat, the wake tower comprising:

a right base member configured to be secured to the boat;

a left base member configured to be secured to the boat;

an inverted U-shaped structure extending from the right base member to the left base member, the inverted U-shaped structure comprising:

a right side portion extending generally upward from the right base member;

a left side portion extending generally upward from the left base member; and an upper portion extending between the right side portion and the left side portion;

a right joint that couples the right side portion to the right base member;

a left joint that couples the left side portion to the left base member, wherein the right and left joints are configured such that the inverted U-shaped structure is movable relative to the right and left base members between an upright position and a lowered position;

a right biasing element having a first end attached to the right base member and a second end attached to the right side portion of the inverted U-shaped structure;

a left biasing element having a first end attached to the left base member and a second end attached to the left side portion of the inverted U-shaped structure, wherein the right and left biasing elements are configured to compensate for at least a portion of the weight of the wake tower to facilitate manually raising and lowering the tower; and a tow rope connector assembly that includes a tow rope connector configured to receive a tow rope, and a positioning element configured to position the tow rope connector generally between the right side portion and the left side portion, wherein the tow rope connector assembly has a first configuration in which the positioning element extends generally upward from the inverted U-shaped structure when the tower is in the lowered position such that the tow rope connector is positioned above the U-shaped structure, and wherein the tow rope connector assembly has a second configuration in which the tow rope connector is not positioned above the U-shaped structure when the tower is in the lowered position, to reduce the height of the tower in the lowered position.

* * * * *